US011326392B2

(12) United States Patent
Tostee

(10) Patent No.: US 11,326,392 B2
(45) Date of Patent: May 10, 2022

(54) LOUVRE SHUTTER SYSTEM

(71) Applicant: INTERIOR CONCEPTS (PTY) LTD, Durban (ZA)

(72) Inventor: Eric Guy Tostee, Durban (ZA)

(73) Assignee: INTERIOR CONCEPTS (PTY) LTD, Ottawa (ZA)

( * ) Notice: Subject to any disclaimer, the term of this patent is extended or adjusted under 35 U.S.C. 154(b) by 108 days.

(21) Appl. No.: 16/613,313

(22) PCT Filed: Mar. 16, 2018

(86) PCT No.: PCT/ZA2018/050013
§ 371 (c)(1),
(2) Date: Nov. 13, 2019

(87) PCT Pub. No.: WO2018/170521
PCT Pub. Date: Sep. 20, 2018

(65) Prior Publication Data

US 2020/0199929 A1 Jun. 25, 2020

(30) Foreign Application Priority Data

Mar. 16, 2017 (ZA) ..... 2017/01871

(51) Int. Cl.
*E06B 7/086* (2006.01)
*E06B 7/09* (2006.01)
(Continued)

(52) U.S. Cl.
CPC ..... *E06B 7/086* (2013.01); *E05F 15/619* (2015.01); *E06B 7/09* (2013.01); *E06B 7/096* (2013.01); *E05Y 2900/146* (2013.01)

(58) Field of Classification Search
CPC ..... E06B 7/084; E06B 7/086; E06B 7/096; E06B 7/09; E05F 15/619; E05F 17/00; E05Y 2900/146
See application file for complete search history.

(56) References Cited

U.S. PATENT DOCUMENTS 2,604,161 A * 7/1952 Bopp ..... E06B 7/084 160/176.1 V
5,469,658 A 11/1995 Digianni et al.
(Continued)

FOREIGN PATENT DOCUMENTS

CN 1128920 C 11/2003
GB 2323122 A 9/1998

OTHER PUBLICATIONS

International Search Report and Written Opinion dated May 31, 2018, issued in PCT Patent Application No. PCT/ZA2018/050013, 9 pages.
(Continued)

*Primary Examiner* — Justin B Rephann
(74) *Attorney, Agent, or Firm* — Grossman, Tucker, Perreault & Pfleger, PLLC

(57) ABSTRACT

A louvre shutter comprising louvres 20 rotatably mounted in a frame on louvre axles, and a louvre drive system that, in summary, comprises a rack and pinion gear system including an externally operable rack assembly and a set of pinion gears 28 mounted to the louvre axles. The rack is externally operable rack and is reciprocably mounted in the drive system housing 42, 48. The pinion gears 28 mounted to the louvre axles are engaged with the rack such that reciprocation of the rack rotates the louvre 20 relative to the frame.

2 Claims, 21 Drawing Sheets

(51) Int. Cl.
*E06B 7/096* (2006.01)
*E05F 15/619* (2015.01)

(56) References Cited

U.S. PATENT DOCUMENTS

| | | | | |
|---|---|---|---|---|
| 6,145,251 | A * | 11/2000 | Ricci | E06B 7/096 49/74.1 |
| 6,314,680 | B1 * | 11/2001 | Buckwaiter | E06B 7/096 49/82.1 |
| 6,848,213 | B1 * | 2/2005 | Swapp | E06B 7/096 49/74.1 |
| 7,353,636 | B1 | 4/2008 | Anderson et al. | |
| 9,732,553 | B2 * | 8/2017 | Rotchell | E06B 7/096 |
| 2002/0148165 | A1 * | 10/2002 | LaMay | E06B 7/086 49/403 |
| 2003/0136053 | A1 * | 7/2003 | Norbert | E06B 7/086 49/74.1 |
| 2005/0076569 | A1 | 4/2005 | Griffiths et al. | |
| 2005/0257429 | A1 * | 11/2005 | Yorgason | E06B 7/096 49/82.1 |
| 2013/0118082 | A1 * | 5/2013 | Colson | E06B 7/096 49/82.1 |
| 2016/0376834 | A1 * | 12/2016 | Meyerink | E06B 9/02 49/82.1 |
| 2017/0335621 | A1 * | 11/2017 | Yen | E06B 7/096 |
| 2018/0179808 | A1 * | 6/2018 | Fraser | E05F 15/619 |
| 2019/0195007 | A1 * | 6/2019 | Yen | E06B 7/096 |

OTHER PUBLICATIONS

Preliminary Report on Patentability dated Sep. 17, 2019, issued in PCT Patent Application No. PCT/ZA2018/050013, 6 pages.

* cited by examiner

LOUVRE SHUTTER SYSTEM

FIELD OF THE INVENTION

This invention relates to louvre shutters and to a louvre shutter system.

BACKGROUND TO THE INVENTION

Shutters are coverings for openings in buildings, such as windows and doors and usually, but not always, each consist of a frame of vertical stiles and horizontal rails, normally top, centre and bottom rails. The shutters may be configured to mount with in the opening or to overlap the opening.

Louvre shutters have louvres, either operable or fixed, horizontal or vertical mounted within the frame.

Operable louvres are typically controlled by a tilt bar or rod to adjust the louvre position and to align the louvres rotationally, keeping the louvres in a uniform position.

The louvre shutters of the invention have operable louvres.

Shutter systems typically comprise multiple, relatively narrow shutters or shutter panels, hingedly mounted to the opening. In multi-shutter systems, often a bi-fold shutter configuration is adopted in which alternating shutters are hinged for folding back on one another, concertina-fashion. In such bi-fold shutter configurations, typically only the end shutters or shutter panels (one or both) are mounted to the opening and the rest of the shutters or shutter panels are hinged, concertina-fashion, to one another.

SUMMARY OF THE INVENTION

According to this invention, a louvre shutter is provided, comprising a frame, a louvre rotatably mounted in the frame on a louvre axle and a louvre drive system mounted within an enclosed housing formed within the frame, the louvre drive system including an externally operable rack reciprocably mounted in the drive system housing and a pinion mounted to the louvre axle, the pinion being engaged with the rack such that reciprocation of the rack rotates the louvre relative to the frame.

The frame preferably comprises a pair of opposed, vertical side stiles and horizontal rails including a top rail and a bottom rail;

the shutter includes a plurality of rotatably operable louvres comprising louvre blades horizontally mounted to the stiles, the louvres being driven to rotate between open and closed positions of the louvres by means of a rack and pinion louvre drive system, in which:

the louvres each include a louvre end plug fixed to the louvre blade at either end of the louvre blade;

the louvre end plugs each have an external boss extending outwardly from an outer face of the louvre end plug, the boss having a right circular cylindrical inner section that constitutes a mounting axle on which the louvre is mounted for rotation within louvre mounting holes pre-formed in the stiles, and an outer section which is formed to define an externally keyed hexagonal driver formation; and a tilter pinion gear is mounted on at least one louvre end plug boss, the tilter pinion gear being formed on the underside thereof, with a hexagonal socket formation shaped complementally to the hexagonal shape of the hexagonal driver.

In the preferred form of the invention, the louvre shutter includes a double shoot bolt lock assembly, comprising:

a lock housing dimensioned to fit within a stile of the louvre shutter frame;

a rack and pinion locking assembly operatively connected to a frame lock bolt, the locking assembly comprising:

a locking assembly rack mounted for reciprocating movement relative to the lock housing and to extend partially into and partially out of the lock housing, the rack being formed with rack gear recesses and a frame lock bolt mounted to the part of the locking assembly rack extending from the lock housing;

a double-sided barrel lock, including a lock pinion gear forming part of a lock barrel that is mounted within the lock housing, the lock barrel being rotatably mounted such that, when rotated, the lock barrel rotates the lock pinion gear, the teeth of which are configured to mesh with the rack gear recesses;

the rack and pinion locking assembly being configured for rotation of the lock pinion gear to drive the locking assembly rack reciprocably relative to the lock housing and for reciprocal movement of the locking assembly rack to drive the frame rock bolt reciprocably into and out of engagement with a locking aperture formed in a surround in which the shutter is mounted in use.

In this embodiment of the invention:

the rack gear recesses within the locking assembly rack that are located within a locking zone of the rack, being the zone adjacent the end of the rack extending from the lock housing, are formed as closed slots, in which the slot recesses are enclosed by the material of the rack and do not extend to the sides of the rack;

the closed recesses being configured to permit entry of the gear teeth of the lock pinion gear only by rotation of the lock pinion gear teeth into the recesses the pinion gear teeth;

the rack gear recesses within the locking assembly rack that are located within an unlocking zone of the rack, being the zone remote from the end of the bolt rack extending from the lock housing, are formed as open-sided slots, in which the slot recesses are only partially enclosed by the material of the rack and extend through to openings on one side of the rack to allow the gear teeth of the lock pinion gear sliding entry from the side of the locking assembly rack.

BRIEF DESCRIPTION OF THE DRAWINGS

The invention will be further described with reference to the accompanying drawings in which.

DESCRIPTION OF EMBODIMENTS OF THE INVENTION

Figure 1:
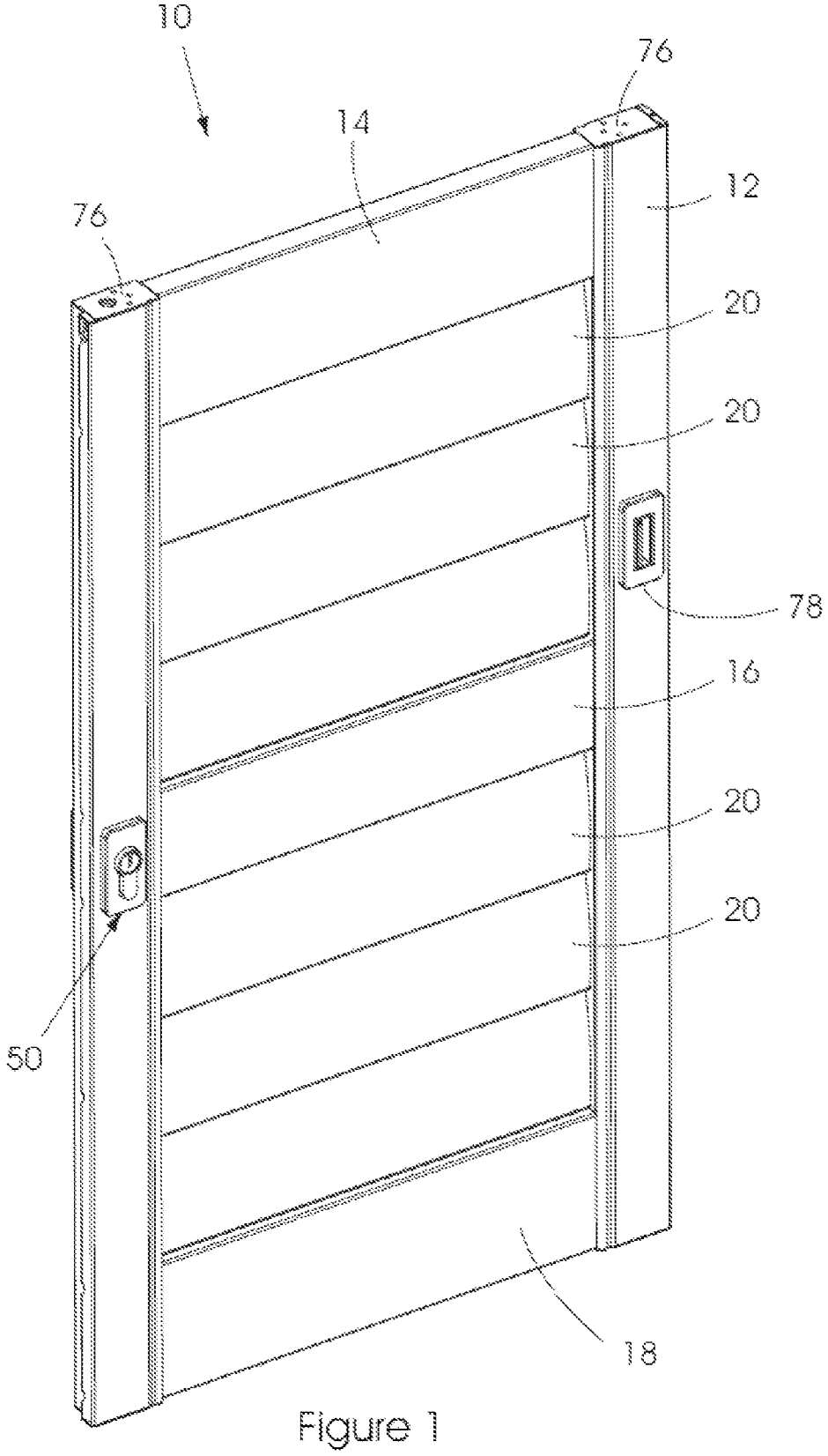
FIG. 1 is an isometric view of a single louvre shutter or louvre shutter panel according to the invention.
Figure 2:
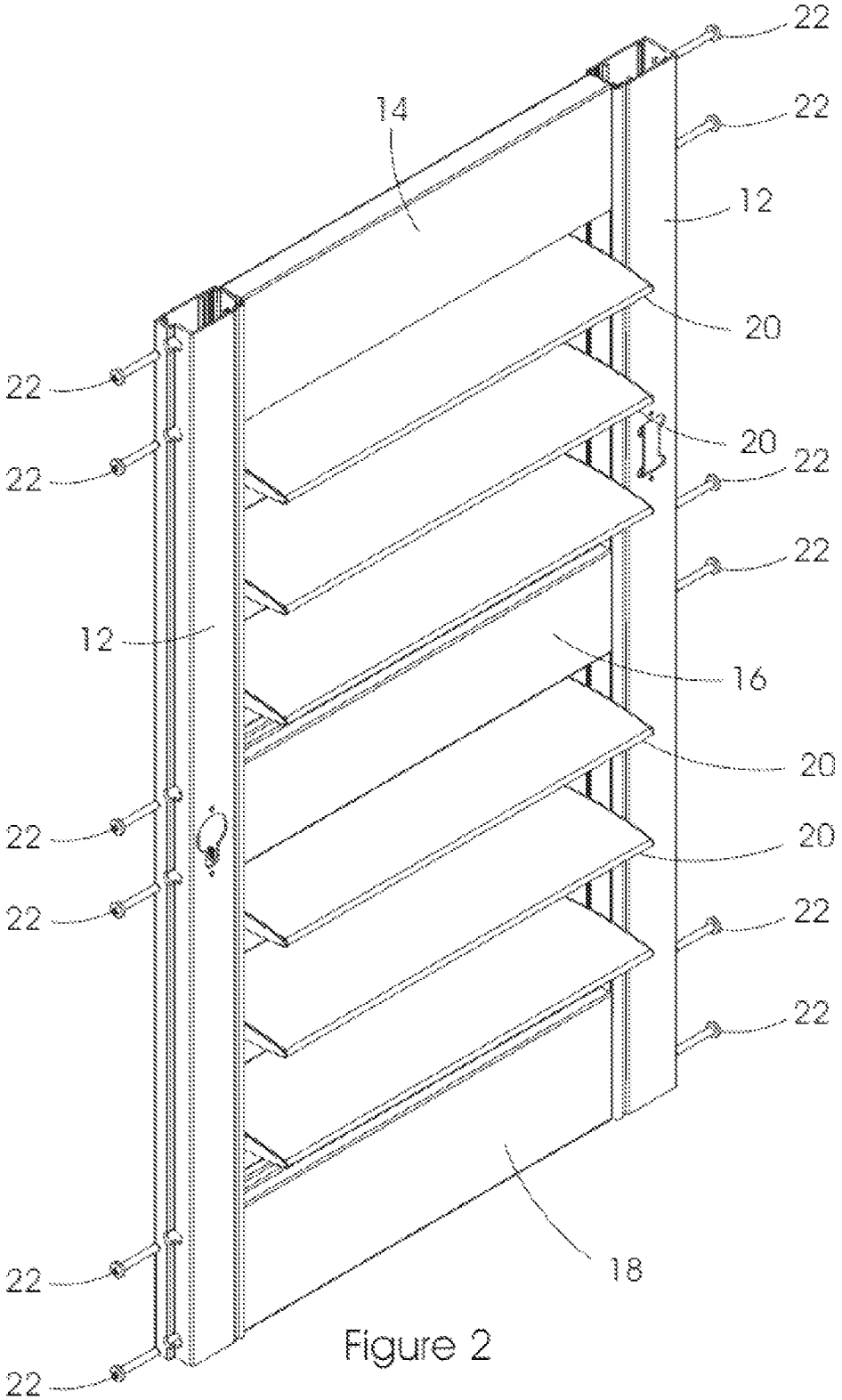
FIG. 2 is a similar isometric view illustrating the shutter of FIG. 1 during assembly.

The shutter 10 illustrated in FIGS. 1 and 2 is a single shutter or shutter panel for use in the shutter system of the invention. The shutter 10 comprises a frame that includes a pair of opposed, vertical stiles 12 and horizontal rails, constituted by a top rail 14, a centre rail 16 and a bottom rail 18.

Being a louvre shutter, the shutter 10 has a plurality of rotatably operable louvres 20 horizontally mounted to the stiles 12. The louvres 20 are driven to rotate between open and closed positions of the louvres 20 by means of a louvre drive system that will be described in more detail below, but that, in summary, comprises a rack and pinion gear system including an externally operable rack assembly and a set of pinion gears mounted to the louvre axles.

As will be seen from what follows, the shutter system of the invention comprises a plurality of the shutters 10 hingedly mounted to the opening or to one another, in which case shutters 10 are hinged, concertina-fashion, to one another.

The stiles 12 are screwed to the top, centre and bottom rails 14, 16, 18 by means of frame screws 22. The frame parts 12, 14, 16, 18 are extruded components—extruded from either aluminium or PVC or as an alternative, the louvre blade 20.1 may be made from wood, preferably solid wood and either natural or engineered wood.

The louvres 20 each include a louvre blade 20.1, which, in the drawing, is illustrated as an extruded component—either extruded aluminium or PVC.

In most cases, similar materials will be used for frame and louvre parts, with PVC being used in damp environments like bathrooms and wood components being used indoors. Aluminium will be used where greater security is required. The shutter system components are designed to work together and to maintain the same look and feel regardless of the material used.

Figure 3:
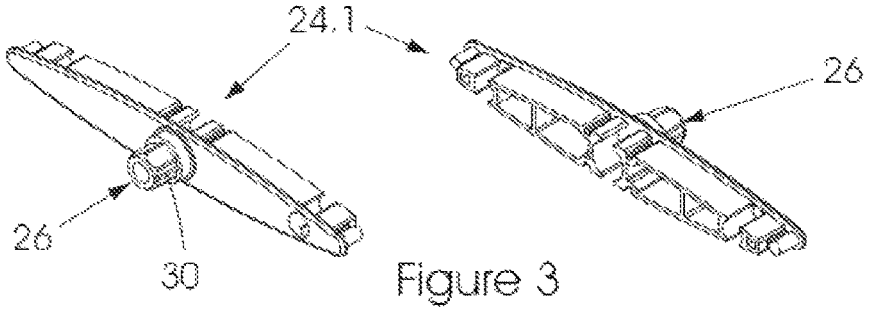
FIGS. 3 and 4 are isometric views of louvre end plugs for the louvres forming part of the louvre shutter of FIG. 1.
Figure 4:
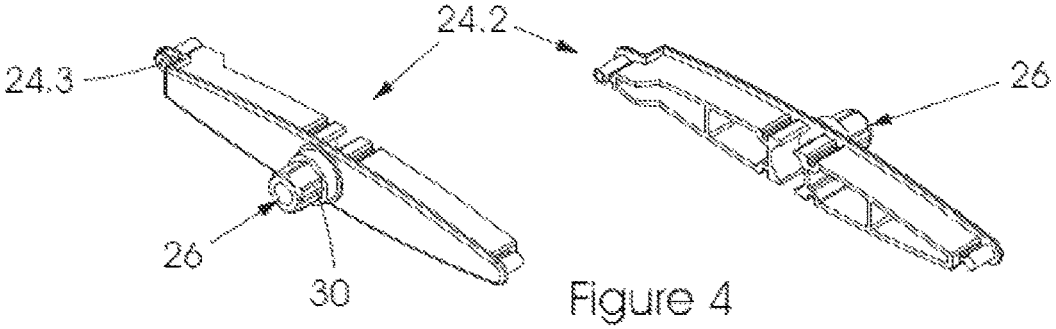
Figure 5:
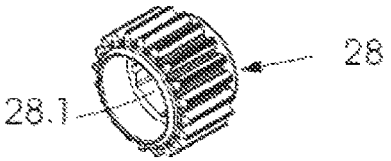
FIG. 5 is an isometric view of a tilter pinion for use in the louvre assembly of FIGS. 1 and 2.
Figure 6:
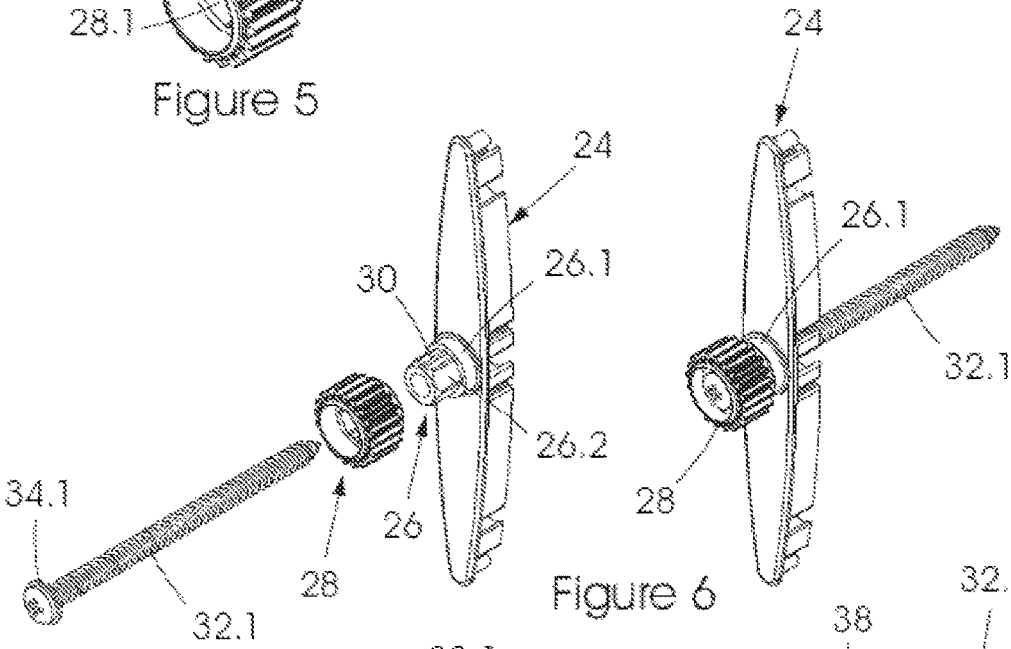
FIG. 6 provides exploded and assembled isometric views, respectively, of a louvre end plug, tilter pinion and screw assembly according to the invention.

A louvre end plug 24 is fixed to the louvre blade 20.1 at either end, the louvre end plug 24 being available in two versions, as illustrated in FIGS. 3 and 4. The louvre end plugs 24 are made from injection moulded plastics, preferably polypropylene.

The preferred louvre end plug 24.1 is illustrated in FIG. 3.

FIG. 4 illustrates a louvre end plug 24.2 that includes an attachment mechanism 24.3 for an external tilter rod (not shown).

The louvre end plugs 24 each have an external boss 26 extending outwardly from the outer face of the louvre end plug 24.

The first, inner section of the boss 26 is smooth and round and constitutes a mounting axle 26.1 on which the louvre 20 is mounted for rotation within louvre mounting holes 47 pre-formed in the stile cover strip 48 (see FIGS. 12 and 13) of the shutter frame.

The outer section of the boss 26 is formed to define an externally keyed hexagonal driver formation 26.2 on which a tilter pinion gear 28 is mounted. The tilter pinion gear 28 may be made from injection moulded plastics, preferably acetal (polyoxymethylene—POM).

The tilter pinion gear 28 forms part of the louvre drive system and is formed, on the inside or underside thereof, with a hexagonal socket formation 28.1 that is shaped complementally to the hexagonal shape of the hexagonal driver 26.2.

The hexagonal driver 26.2 includes a key formation 30 and the hexagonal socket formation in the tilter pinion gear 28 is formed to include a complementally shaped key slot (not shown). Engagement of the key formation 30 with the key slot in the pinion gear 28 facilitates rotational alignment of the louvres 20 during assembly and use of the shutter 10.

The pinion gear 28 assembly is needed on only on one side of the shutter frame. On the other side of the shutter frame, the pinion gears 28 are dispensed with and the louvre 20 is simply mounted on the mounting axle 26.1 forming part of the boss 26 on that side of the frame.

The tilter pinion gear 28 is assembled to the louvre end plug 24 by means of a purpose-designed truss head louvre screw 32.1 that includes an integral washer formation 34.1. During assembly, the louvre screw 32.1 is screwed, through the louvre end plug 24, into an extruded screw channel 36 formed in the louvre blade 20. In the process, the integral washer formation 34.1 engages a shoulder formed within the tilter pinion gear 28, thereby securing the pinion gear 28 to the hexagonal driver 26.2 forming part of the boss 26 on the louvre end plug 24.

Figure 7:
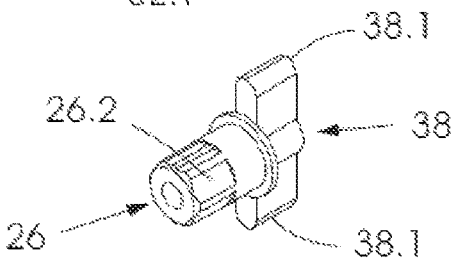
FIG. 7 is an isometric view of a louvre pinion connector for a wooden louvre according to the invention.
Figure 8:
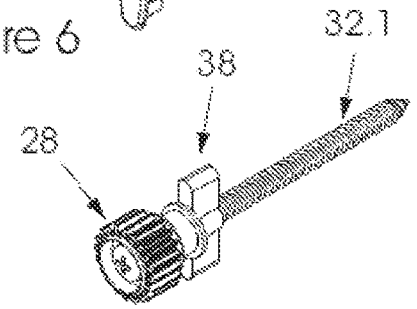
FIG. 8 is an isometric view of the pinion connector of FIG. 7 assembled into a filter pinion and screw assembly.
Figure 9:
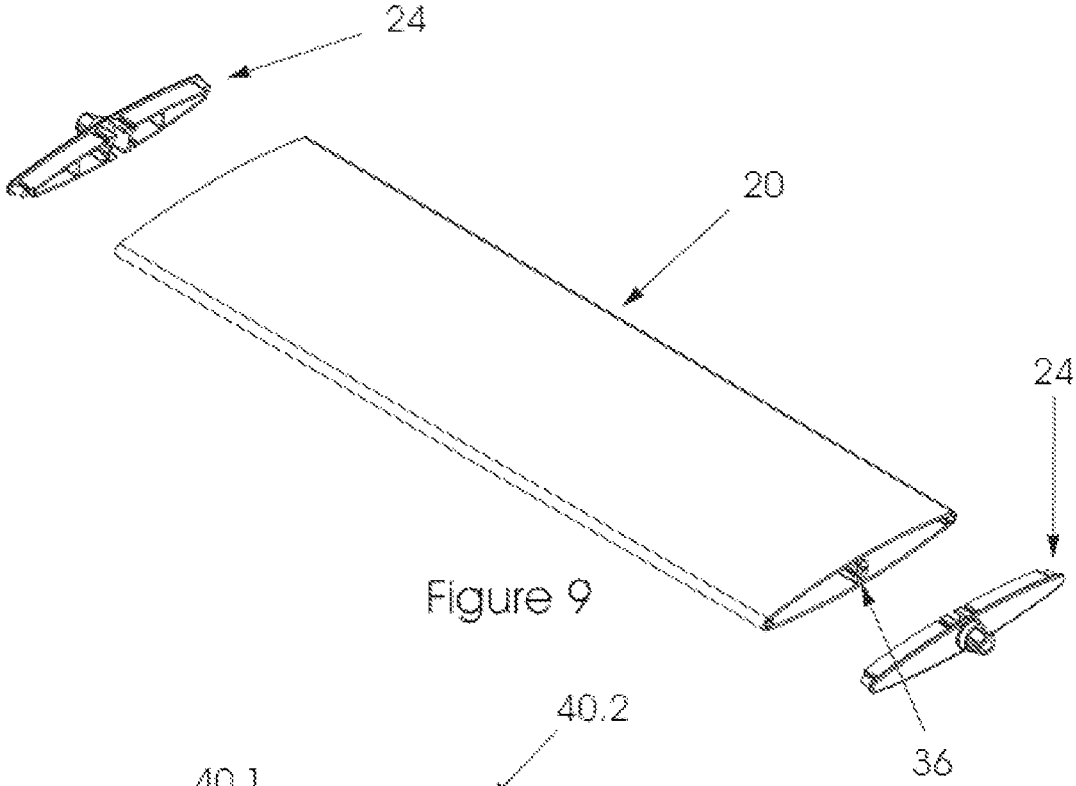
FIG. 9 is an exploded isometric view of an extruded louvre with end caps.

FIGS. 7 and 8 illustrate a modified tilter pinion gear assembly for use with wooden louvres (not shown). This assembly includes a pinion connector 38 with radially extending lobes 38.1. To assemble the pinion connector 38 to a wooden louvre, the end of the louvre is first formed (by means of a router for instance) with a housing shaped complementally to the pinion connector 38, which is then secured, by means of a louvre screw 32.1, into the housing formed in the wooden louvre. The pinion connector 38 includes a boss 26 and hexagonal driver 26.2 similar to those found on the louvre end plugs 24, likewise to retain a pinion gear 28.

The final assembly of the pinion connector 38 with a pinion gear 28 and a louvre screw 32.1 is illustrated in FIG. 8. Once secured to a wooden louvre, the pinion gear 28 and the wooden louvre operate in identical fashion to the extruded louvre and end plug assemblies (20, 24) described above.

Figure 10:
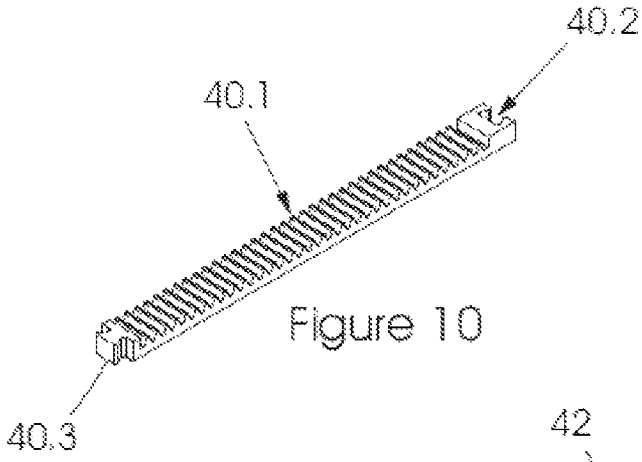
FIG. 10 is an isometric view of a rack module for a modular tilter rack according to the invention.

The louvre drive system is a rack and pinion system. The pinions in the louvre drive system are constituted by the tilter gear pinions 28. The tilter rack forming part of the louvre drive system is illustrated in FIGS. 10 and 11.

The preferred tilter rack is a modular rack 40 constituted by a plurality of snap-together tilter rack modules 40.1 made from injection moulded plastics, preferably acetal (polyoxymethylene—POM). The rack modules 40.1 are formed with mutually engageable snap fastening formations 40.2, 40.3 that are snapped together to obtain a tilter rack 40 of the desired length.

Figure 11:
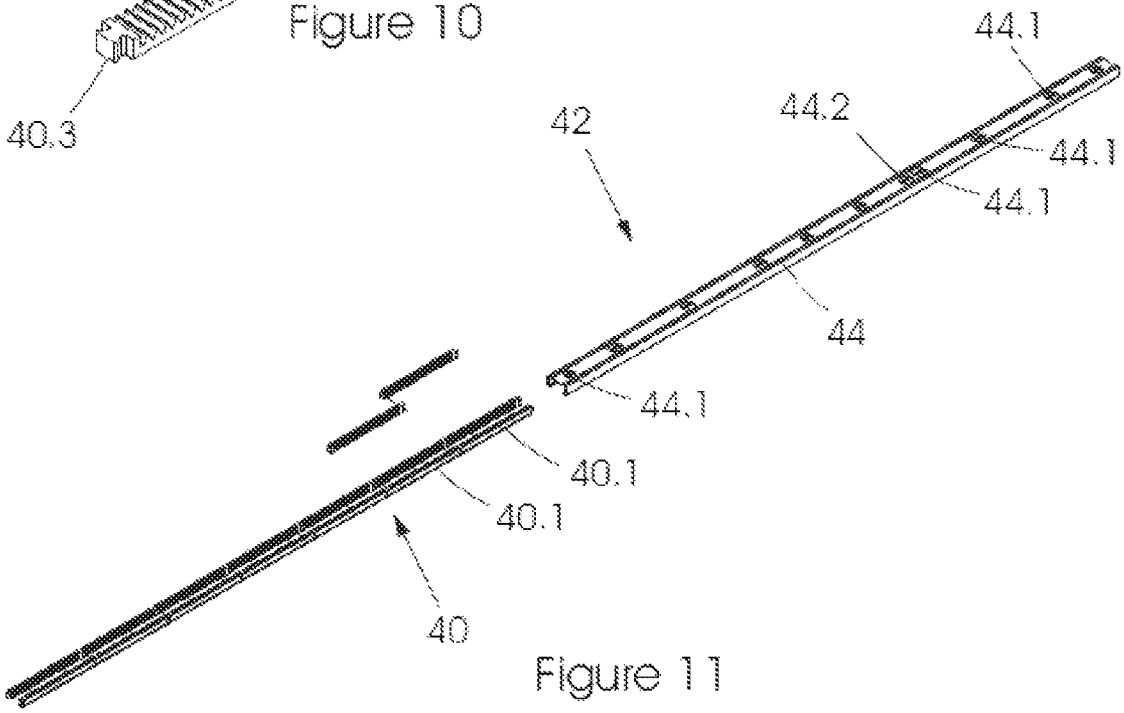
FIG. 11 is an isometric view illustrating the assembly of the tilter rack of the invention into a tilter rack carrier.

FIG. 11 illustrates a rack assembly 42 in the process of construction, the rack assembly 42 comprising a pair of tilter racks 40 that are positioned for sliding into rack retaining tracks on either side of a tilter rack carrier 44. The tilter rack carrier 44 is preferably an extruded component—extruded from aluminium. The tilter rack carrier 44 is pre-formed with louvre mounting holes 44.1 and a control module gear axle hole 44.2, the purposes of which are described below.

Figure 12:
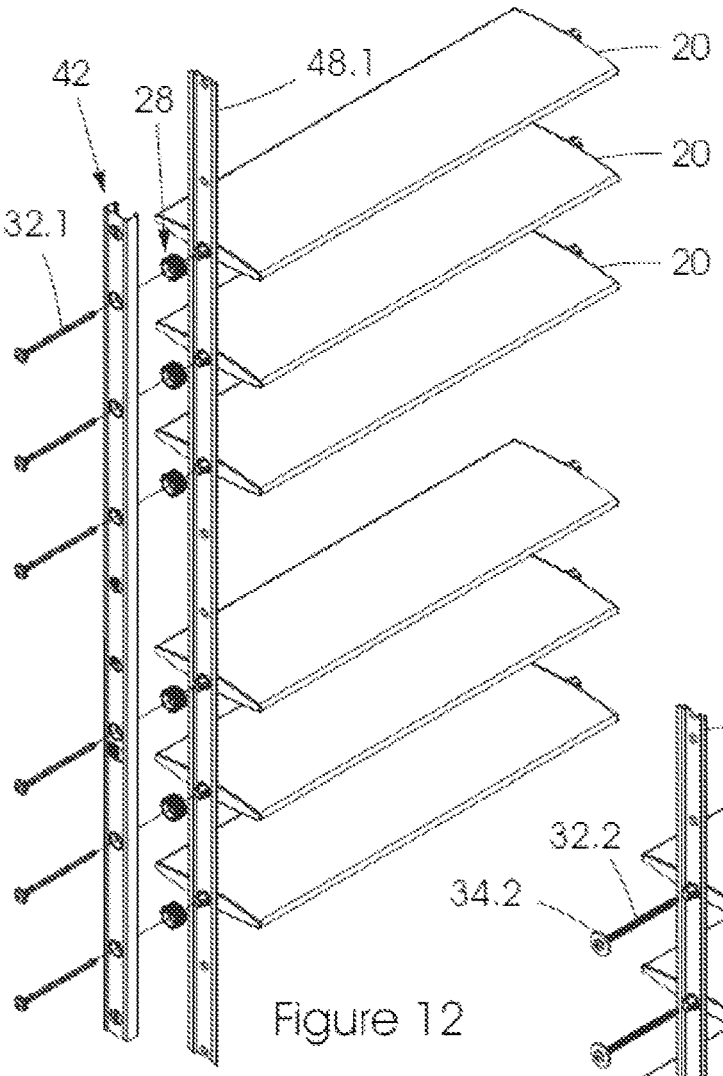
FIG. 12 is an exploded isometric view of a plurality of louvres in the process of securement to a tilter rack carrier according to FIG. 11.
Figure 13:
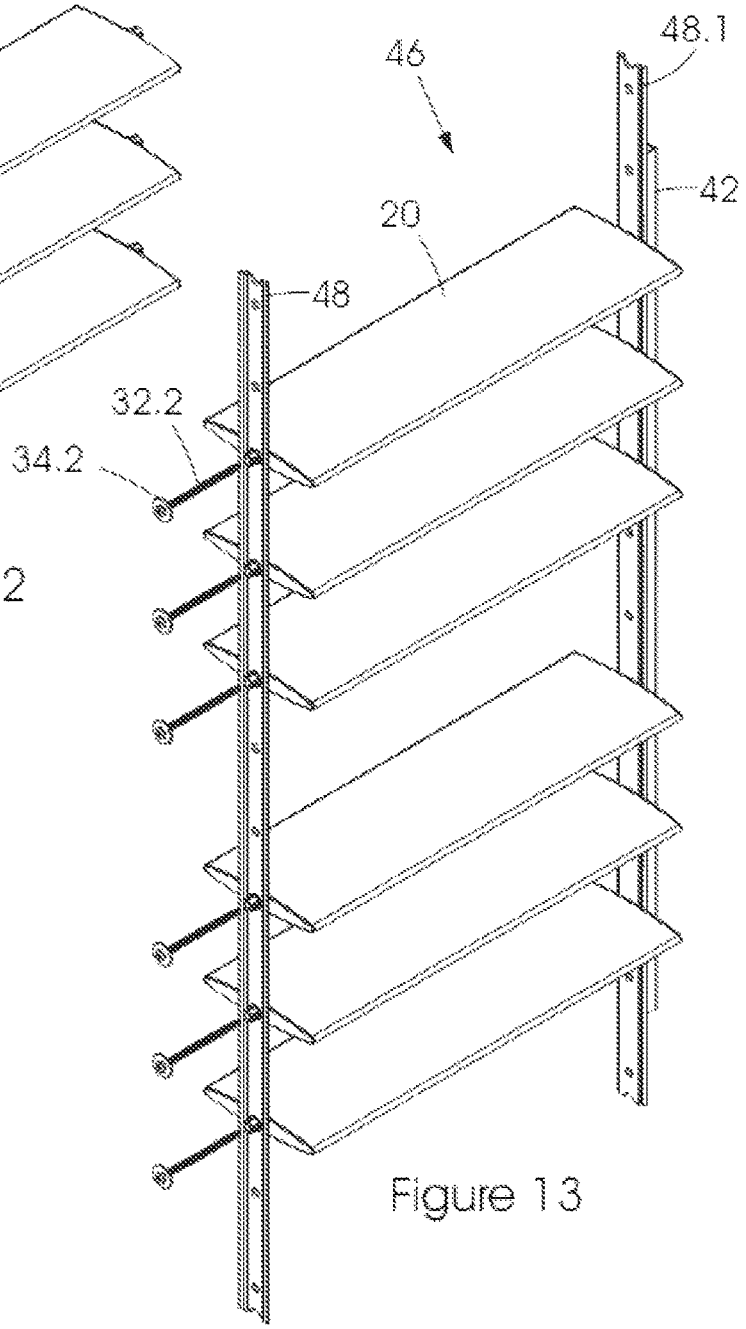
FIG. 13 is a similar exploded isometric view of the assembly of FIG. 12 viewed from the other side.

FIGS. 12 and 13 illustrate the construction of a louvre sub-assembly 46 prior to the inclusion thereof in a shutter 10. In the louvre sub-assembly 46, the louvres 20 are mounted with their axles 26.1 freely rotatable in a pair of opposed stile cover strips 48. The louvres 20 are retained in the stile cover strips 48 by louvre screws 32.1 that, on one side of the louvre sub-assembly 46, besides retaining the tilter pinion gears 28 in place on the hexagonal drivers 26.2 of the louvres 20, also retain the tilter rack assembly 42 in place on the stile cover strip 48.1 on that side of the louvre sub-assembly 46. The louvre screws 32.1 and the tilter pinion gears 28 secure the louvres 20 in the stile cover strip 48 against forced removal.

The louvres 20 are driven only on the one side, hence, in the sub-assembly 46, only one stile cover strip 48.1 has a tilter rack assembly 42 secured thereto. On that side of the sub-assembly 46, the louvres 20 are provided with tilter pinion gears 28 mounted on the louvre end plug hexagonal drivers 26.2. On the other side of the sub-assembly 46, the louvres 20 are secured with louvre screws 32.2 in which the size of the truss heads (the integral washers 34.2) are enlarged compared to the truss heads 34.1 of the louvre screws 32.1 on the other side of the sub-assembly 46. The enlarged truss heads 34.1 provide the same degree of security against forced removal of the louvres 20 compared to the louvre screw 32.1/tilter pinion gear 28 combinations.

Figure 14:
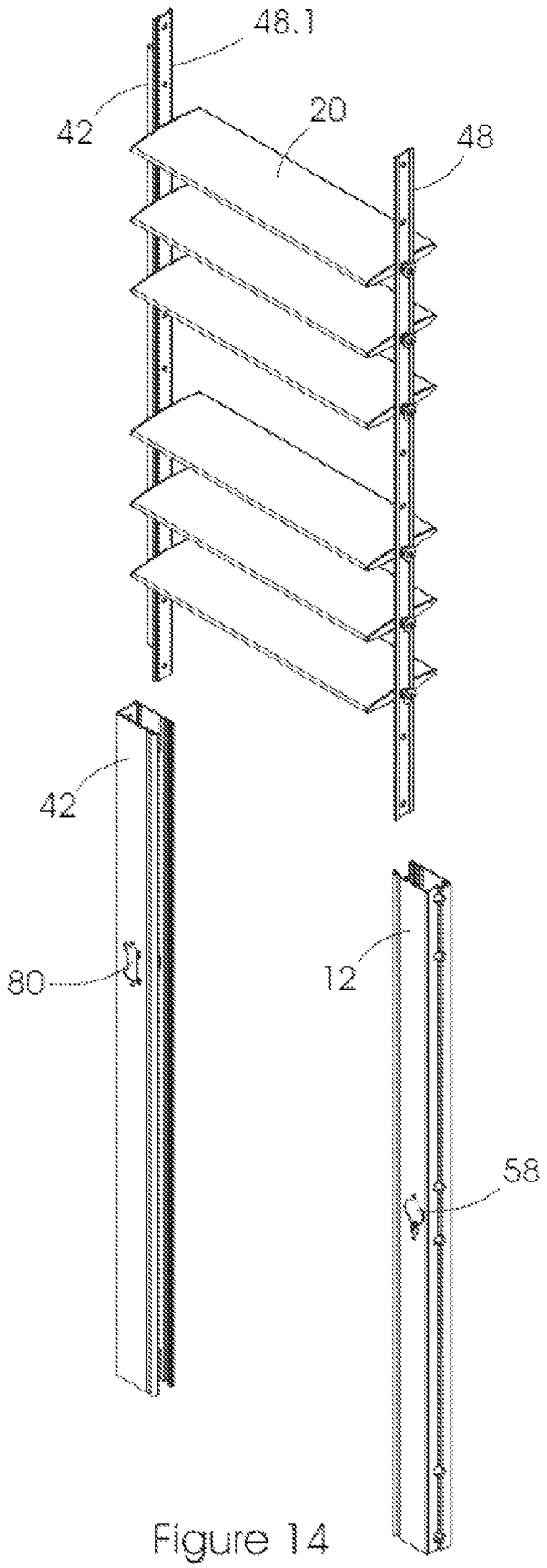
FIG. 14 is an exploded view of the insertion of the louvre assembly of FIGS. 12 and 13 into a pair of vertical stiles.
Figure 15:
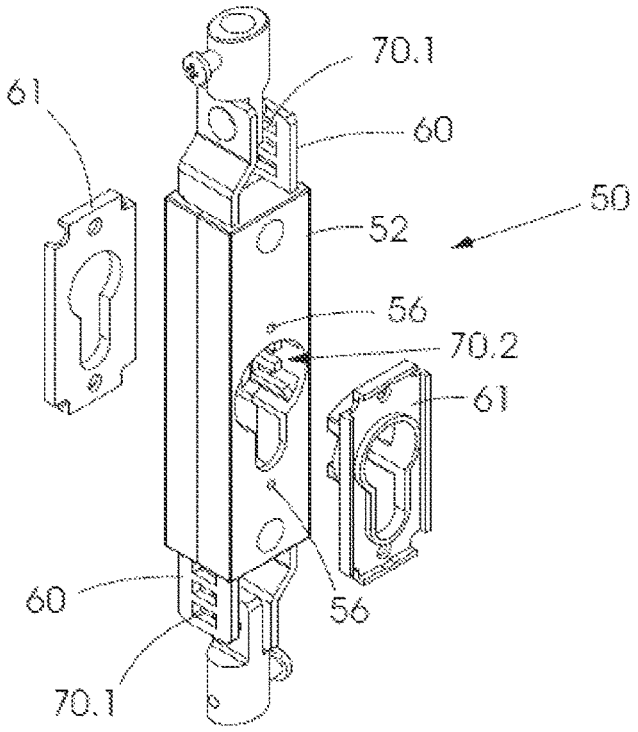
FIG. 15 is a partially exploded isometric view of a double shoot bolt lock housing according to the invention.

FIG. 14 illustrates the louvre sub-assembly 46 just prior to its insertion into a pair of stiles 12. The stiles 12 are extruded components that are described in more detail with reference to FIGS. 40 and 41. The stile profile includes track formations that are configured to accept slidable insertion of stile cover strips 48, which are secured in place when the top-, centre- and bottom rails 14, 16, 18 are secured to the stiles 12 by means of the frame screws 22.

In the louvre sub-assembly 46, the tilter rack assembly 42 is secured, by means of the stile cover strip 48.1, such that the gear teeth of the tilter pinion gears 28 mounted to the louvres 20 engage the complementally shaped gear teeth of the tilter racks 40 in the tilter rack assembly 42. Rotational movement of any one of the louvres 20 about its axis of rotation (on the louvre axles 26.1) by manual manipulation of that louvre 20, will rotate the tilter pinion gear 28 mounted to that louvre 20. Rotation of that tilter pinion gear 28 drives the tilter racks 40 meshed with the pinion gear 28 to slide in opposite directions within the tilter rack carrier 44. The movement of the tilter racks 40, which are engaged with the tilter pinion gears 28 of all the other louvres 20 in the louvre sub-assembly 46, drive the tilter pinion gears 28 of the other louvres 20 to rotate those other louvres 20 by the same amount of rotation as the manually manipulated louvre 20. In this way, the rack and pinion louvre drive system retains the louvres 20 in rotational alignment.

The shutter locking arrangement includes a double shoot bolt lock assembly 50 comprising a lock housing 52 dimensioned to fit entirely within the stile 12. The lock housing 52 is mounted in the stile 12 by means of mounting screws 54 secured into screw holes 56, 57 formed in the lock housing 52 and the stile 12 respectively. This positions the lock housing 52 within a lock mortice 58 routed into the stile 12.

The lock housing 52 houses a pair of bolt racks 60 that are reciprocably mounted in the housing 52.

Figure 16:
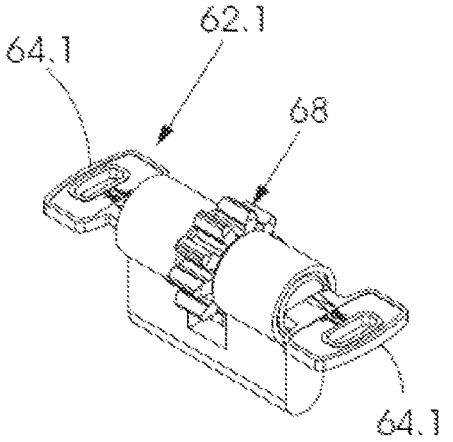
FIGS. 16 to 18 are isometric views of alternative barrel locks for use with the double shoot bolt lock of FIG. 15.
Figure 17:
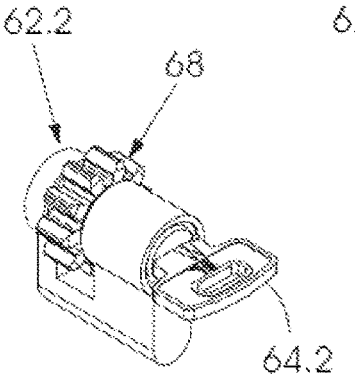
Figure 18:
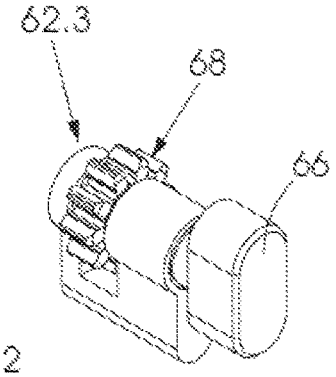

In addition, the lock housing 52 houses one of at least three types of barrel lock 62, which are illustrated in FIGS. 16 to 18.

The first barrel lock 62.1 includes a barrel that is lockable by means of keys 64.1 inserted from either end of the barrel. The double-sided barrel lock 62.1 is suitable for use on an externally facing shutter 10 and enables locking and unlocking of the shutter 10 from both the interior and exterior of the shutter 10.

The second barrel lock 62.2 includes a barrel that is lockable by means of a key 64.2 insertable only from the one end of the barrel. This type of lock is suitable for use on externally facing shutters 10, but is more commonly intended for use on internally facing shutters 10, since the single-sided barrel lock 62.2 permits locking and unlocking of the shutter 10 only from the one side of the shutter 10.

The third barrel lock 62.3 is not key-lockable and, instead, is rotated by means of a thumb turn handle 66 that is operable from one side of the shutter 10 only. The thumb turn barrel lock 62.3 finds particular application in locking intermediate shutters 10 in bi-fold shutter systems against opening, thereby obviating the need for multiple key locks. In such a bi-fold shutter system, only the end shutter 10 might require a lock. Hinged or pivoted shutters 10 intermediate the ends of such a shutter system simply require a thumb turn lock 62.3 to lock the intermediate hinged shutters 10 from hinging open.

The lock assembly 50 is closed by means of internal cover plates 61 that are secured to either side of the stile 12 by means of the screws 54.

A decorative cover plate 63 clips over the internal cover plate 61 on either side of the stile 12 to finish off the shutter 10.

The barrel locks 62 all include a rotatable barrel that, when rotated by means of the key 64 or the thumb turn handle 66, drives a lock pinion gear 68. The teeth of the lock pinion gear 68 mesh with matching gear recesses 70 formed in the bolt racks 60. Rotation of the lock pinion gear 68 drives the bolt racks 60 reciprocably into and out of the lock housing 52, thereby reciprocating upper and lower lock bolts 72 (only the upper lock bolt 72 is illustrated) into and out of engagement with locking apertures (not shown in the drawings) formed in the shutter mounting frame (not shown in the drawings). When the lock bolts 72 are engaged with the locking apertures, the shutter 10 is locked to the frame and cannot be opened.

The shutter locking arrangement is configured to ensure that the barrel lock 62 can only be removed when the lock 62 is in the unlocked position—that is when the lock bolts 72 are in the unlocked position, thereby enhancing the safety and security of the shutter locking arrangement and shutter systems including the shutter locking arrangement.

In the locked position of the lock bolts 72, the barrel lock 62 locks the lock bolts into the shutter frame and the bolt racks 60 and pinion gear 68 together ensure that the locking assembly 50 can only release and unlock the lock bolts by proper operation of the barrel lock 62 with the use of a key 64, for instance.

The gear recesses 70.1 within the locking zones of the bolt racks 60 (the zones adjacent the free ends of the bolt racks 60) are constituted by closed slots—the slot recesses 70.1 are fully enclosed by the material of the bolt rack 60 and do not extend to the sides of the bolt rack 60. In this manner, the closed gear recesses 70.1 in the locking zones of the bolt racks 60 permit entry of the gear teeth of the lock pinion gear 68 only by penetration arising from rotation of the lock pinion gear teeth into the recesses 70.1—the pinion gear teeth cannot slide transversely into and out of the closed slots constituting the gear recesses 70.1.

The gear recesses 70.2 within the unlocking zones of the bolt racks 60 (the zones remote from the free ends of the bolt racks 60) are constituted by open-sided slots—the slot recesses 70.2 are only partially enclosed by the material of the bolt rack 60 and extend through to openings on one side of the ball track to allow the gear teeth of the lock pinion gear 68 sliding entry from the side of the bolt rack 60.

The open gear recesses 70.2 in the unlocking zones of the bolt racks 60 permit entry of the gear teeth of the lock pinion gear 68 by rotational penetration of the lock pinion gear teeth into the recesses 70.2 and by sliding penetration—the pinion gear teeth can slide transversely into and out of the open-sided slots constituting the open gear recesses 70.2. This makes it possible to slide the lock housing 52 in and out of the lock housing 52, for instance during assembly of the stile 10 or to allow removal of the barrel lock 62.

When the lock bolts 72 are unlocked, which is when the barrel lock 62 has been unlocked and rotated to drive the bolt racks 60 to the open position of the lock bolts 72, the open gear recesses 70.2 in the unlocking zones of the bolt racks 60 are engaged with the gear teeth of the lock pinion gear 68. In this position, the gear teeth of the lock pinion gear 68 can slide transversely into and out of the open-sided slots constituting the open gear recesses 70.2. This makes it possible to slide the barrel lock 62 in and out of the lock housing 52, for instance during assembly of the stile 10 or to allow maintenance access to the locking mechanism.

The closed gear recesses 70.1 in the bolt racks 60 enhance the security of the lock, since the locking arrangement, once locked will remain locked. If, for example, the locking arrangement is locked and a thief should nevertheless gain unauthorised access to the lock housing 52, for instance by removal of the cover plates 61, 63, the thief will still be unable to release the lock bolts 72. To do this, the thief would have to remove the barrel lock 62 from the lock housing 52 to release the bolt racks 60 and to slide the lock bolts 72 out of engagement with the shutter frame. This is because, when locked, the teeth of the lock pinion gear 68 are engaged with the closed gear recesses 70.1 in the locking zones of the bolt racks 60. In this position, the lock pinion gear teeth cannot slide transversely out of the closed slots constituting the gear recesses 70.1 and the closed gear recesses 70.1 retain the barrel lock 62 firmly secured within the lock housing 52, retaining the lock bolt 72 in the locked position.

Figure 19:
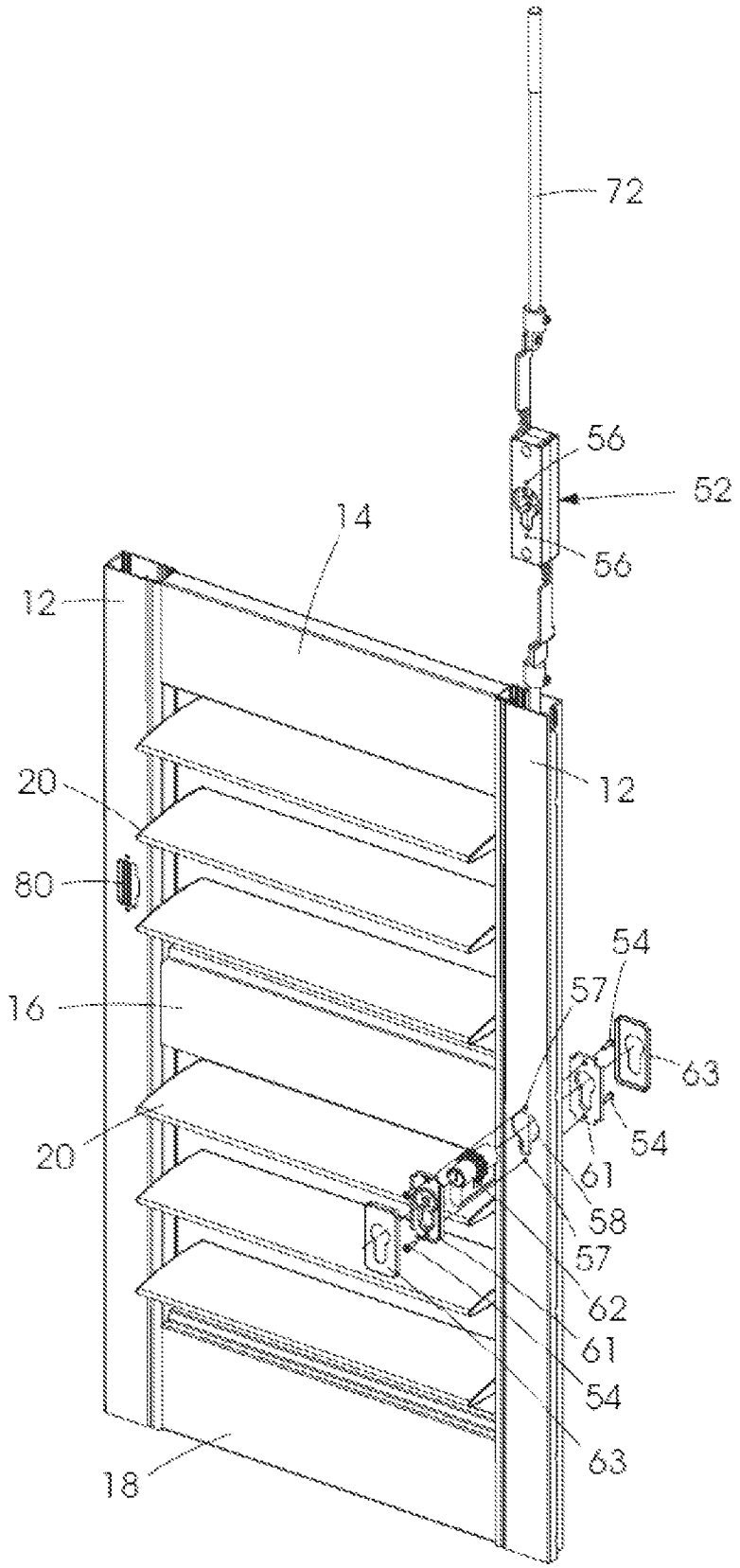
FIG. 19 is an exploded isometric view of the assembly of the bolt and lock assembly of FIGS. 15 to 18 into a shutter according to the invention.
Figure 20:
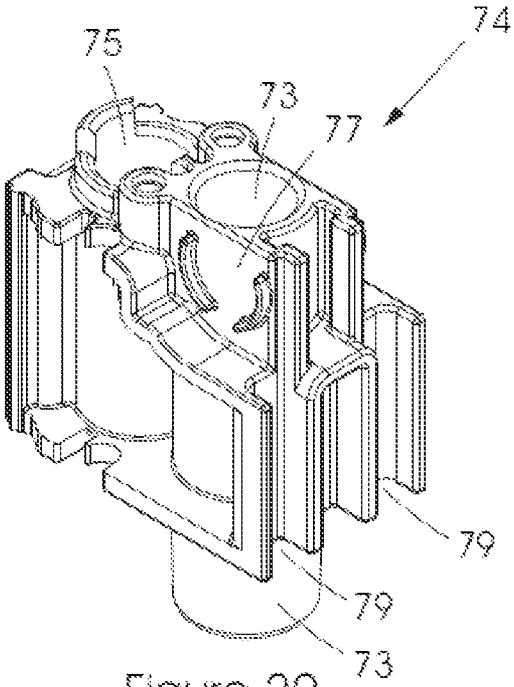
FIGS. 20 to 22 are an isometric view, a plan view and an under plan view, respectively, of a stile insert or stile plug according to the invention.
Figure 21:
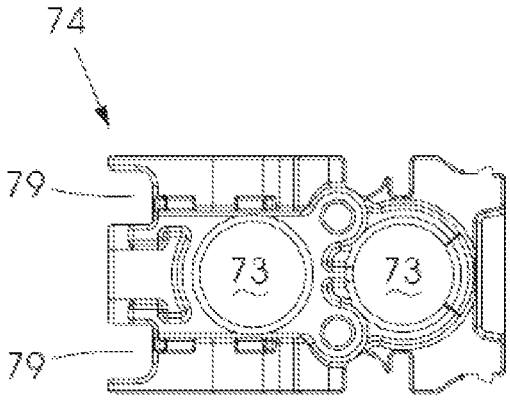
Figure 22:
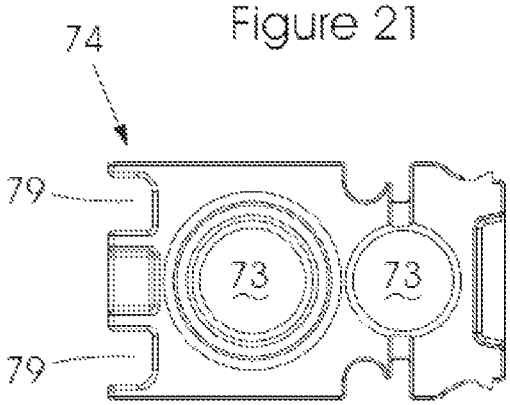

Once the lock bolts 72 and lock housing 52 have been mounted within the stile 12 (FIG. 19) stile inserts or plugs 74 (see FIGS. 20 to 22) are secured within the open ends of the stiles 12.

The stile plug 74 is provided with a lock bolt guide tube 73 within which the lock bolt 72 is accommodated and which guides the lock bolt 72 during operation of the locking arrangement. A tubular housing 75 is formed within the stile plug 74 to house the pivot tubes of the pivot assemblies described below.

The stile plug 74 is formed with a magnet housing 77 within which a small, concealed magnet is secured (not shown). The concealed magnets in adjacent shutters lock the shutters 10 to one another magnetically when, in use, the shutters 10 are fully opened and stacked up against one another.

The stile plugs 74 are closed by means of stile plug closing plates 76. To allow passage of the lock bolt 72, a hole 71 is formed in the stile plug closing plates 76.1.

The stile plugs 74 are injection moulded plastics components, preferably made from glass filled nylon. The stile plug closing plates 76 are made from injection moulded plastics, preferably polypropylene. Both the stile plugs 74 and the stile plug closing plates 76 are configured for use with extruded aluminium and extruded PVC shutter systems.

The stile plug 74 and stile plug closing plates 76 are configured to retain and guide the ends of the lock bolts 72 at the top and bottom of the shutter 10.

As will be described below, the stile plugs 74 and stile plug closing plates 76 are configured to support top and bottom pivots as well as a top runner and bottom guide. In addition, the stile plugs 74 are configured to accommodate an automation harness which will be described in more detail below.

The shutter 10 includes a louvre lock 78 that is secured within a recess 80 formed within one of the stiles 12. The louvre lock 78 comprises a pivoted rocker that includes a rocker arm 82 and a rocker handle 84, joined together and pivotably mounted on a pivot mounting 86. The end of the rocker arm 82 includes a toothed gripper 88, the teeth of which are complemental to the gear teeth on the tilter rack 40.

The louvre lock 78 is installed within the stile opening 80 by means of screws 90 such that the gripper 88 is aligned with one of the tilter racks 40 mounted within the stile 12. The rocker arm is pivoted by means of the handle 84 between positions in which the teeth of the gripper 88 are either engaged with or disengaged from the teeth of the tilter rack 40. When engaged with gear teeth of the tilter rack 40, the teeth of the gripper 88 lock the tilter rack 40 in position, thereby preventing subsequent rotation of the louvres 20.

The pivot mounting 86 may include an over-centre lock mechanism that biases the rocker arm 82 to either engage with or disengage from the teeth of the tilter rack 40.

The louvre lock 78 is made from injection moulded plastics, preferably glass filled nylon. A decorative cover plate 92 is provided to finish off the stile 12.

Figure 29:
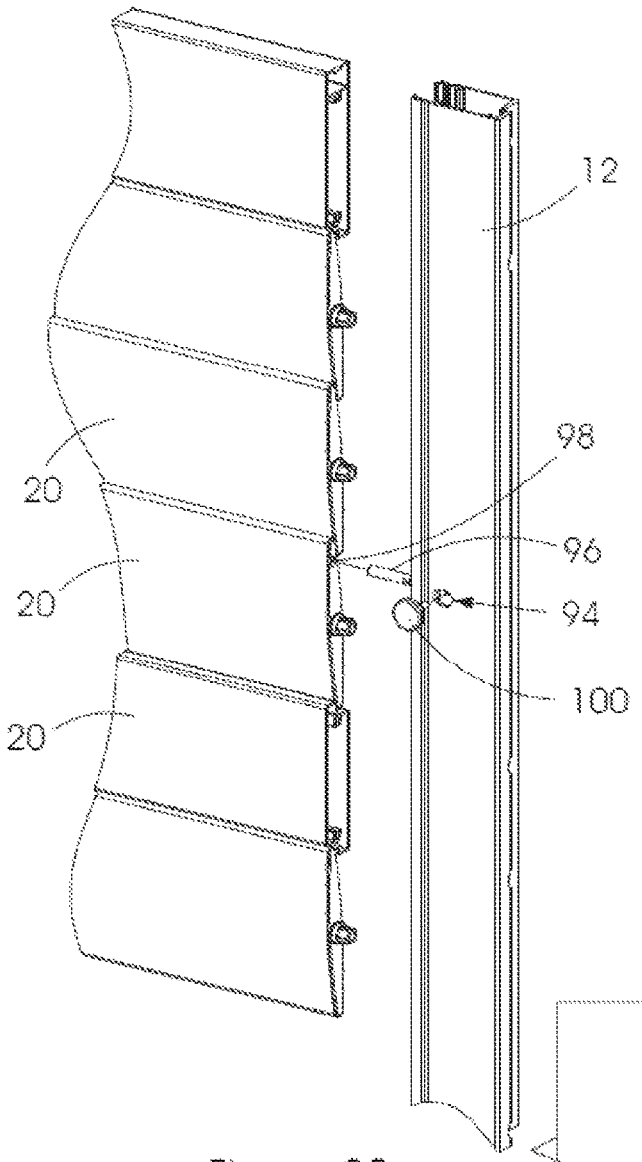
FIGS. 29 and 30 are isometric views illustrating an alternative or additional louvre lock.
Figure 30:
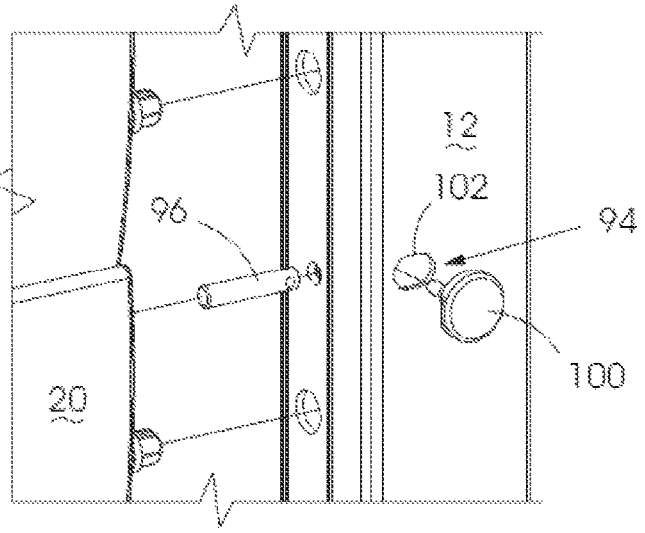

A more secure locking arrangement is illustrated in FIGS. 29 and 30 which show a dead-bolt louvre lock 94 comprising a dead bolt pin 96 that is configured and positioned to engage a dead bolt aperture 98 formed in one of the louvres 20 when the louvres 20 are rotated to the fully closed position.

A deadbolt handle 100 is screwed into a tapped screw hole formed in the deadbolt pin 96. The handle 100 is located within a slot 102 formed in the stile 12. The handle 100 is used to slide the deadbolt pin 96 into and out of engagement with the deadbolt aperture 98 either to lock the louvres 20 in the closed position (deadbolt 96 engaged) or to unlock the louvres 20 (deadbolt 96 disengaged).

Where the shutter system is a bi-fold system, the shutters are normally pivotably mounted to a frame and to one another on pivot mountings secured adjacent the vertical sides of the shutters.

In a typical bi-fold shutter system, a first side of the first shutter is hinged, by means of top and bottom pivots to a vertical side of the frame. The second side of the first shutter is hinged on hinges to a first side of the second shutter. The hinge point or axis between the first and second shutters is un-supported, since the hinge axis between the first and second shutters must be allowed to pop into and out of the plane of the frame when, during closing and opening of the shutters, the first and second shutters rotate (on the hinges) into and out of the frame plane.

The second side of the second shutter is hinged on hinges to the first side of a third shutter. The hinge axis between the second and third shutters is supported on a sliding pivot that is guided along a top track 53 and a bottom track 51,52 forming part of the shutter frame to slide the hinge axis within the frame plane during opening and closing of the shutters. The second and third shutters, on either side of their hinge axis, rotate (on the hinges) into and out of the frame plane during closing and opening of the shutters, but the hinge axis between the second and third shutters remains within and simply slides along the frame plane defined by the top (50) and the bottom (51,52) tracks, during closing and opening of the shutters.

This arrangement is repeated as many times as there are shutters.

In such a shutter system, alternating hinge axes are supported on sliding pivots sliding in the track, for sliding movement along the track and within the frame plane, and the hinge axes between them are un-supported to allow the shutters and the un-supported hinge axes to pop into and out of the frame plane during closing and opening of the shutters.

The shutters 10 of the invention lend themselves to assembly into a bi-fold shutter system in which a first side of a first shutter 10 is pivoted adjacent to a vertical side of a shutter system frame. The preferred pivot mounting for such a shutter system is a pair of fixed supported assemblies fixed to the top and bottom frame members.

Figure 31:
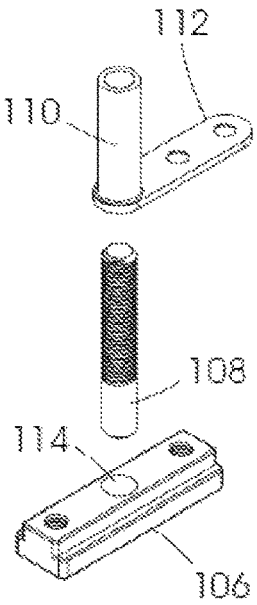
FIGS. 31 to 39 are isometric views of pivot assemblies for the shutters of the invention.
Figure 33:
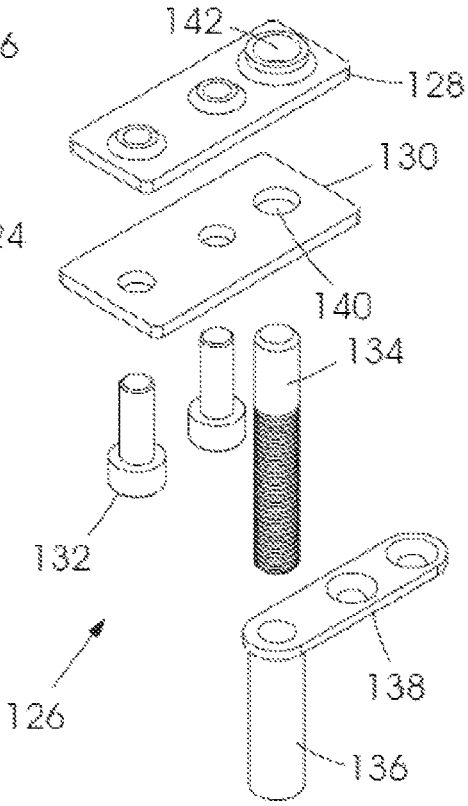

Bottom and top pivot assemblies 104, 126 are illustrated in FIGS. 31 and 33. These pivot assemblies are relatively high-security assemblies that are intended for use with extruded aluminium shutters.

The bottom pivot assembly 104 illustrated in FIG. 31 comprises a base plate 106 configured for securement to the bottom of the shutter system frame, either to a recessed or a surface-mounted track. The assembly 104 includes a pivot pin 108 that is screwed into a pivot tube 110 attached to a bracket plate 112. The bracket plate 112 is screwed into the bottom rail 18 of the shutter and secures the pivot tube 110 in the pivot tube housing 75 formed in the stile plug 74 forming part of the shutter. The free end of the pivot pin 108 is inserted into a pivot pin aperture 114 formed in the base plate 106 during assembly of the shutter to the frame, to provide a bottom fixed pivot and a non-sliding hinge axis for the shutter. The shutter height is adjusted by means of washers (not shown) threaded onto the pivot pin 108 during assembly of the shutter to the frame.

The adjusting washers effectively render the shaft of the pivot pin 108 inaccessible. The washers prevent unauthorised removal of the shutter from the frame, since the pivot pin 108 cannot be screwed any deeper into the pivot tube 110 to release the shutter from the frame, for instance.

FIG. 33 illustrates a similar pivot assembly 126 configured as a top pivot assembly. Instead of a base plate, the top pivot assembly 126 includes a pair of clamping plates 128, 130 that are bolted together by means of machine screws 132 to clamp a section of the top track (not shown in this drawing) between the clamping plates 128, 130, thereby to secure the pivot assembly 126 in place on the top track. The assembly 126 includes a pivot pin 134 that is screwed into a pivot tube 136 attached to a bracket plate 138. The bracket plate 138 is screwed into the top rail 14 to secure the pivot tube 136 in the pivot tube housing 75 formed in the stile plug 74. The free end of the pivot pin 134 is inserted into the matching pivot pin apertures 140, 142 114 formed in the clamping plates 128, 130 to provide a top fixed pivot and a non-sliding hinge axis for a shutter 10.

Figure 32:
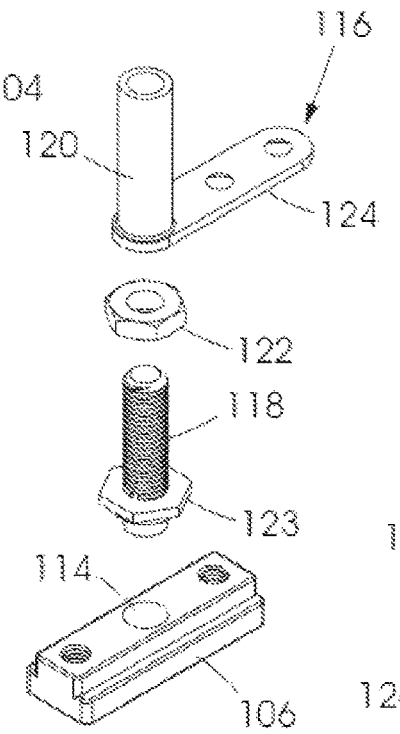

A bottom pivot assembly 116 made specifically for wooden shutters 10 is illustrated in FIG. 32. The pivot assembly 116 differs from the pivot assembly 104 in the provision of a height-adjustment mechanism. The pivot assembly 116 includes a pivot pin 118 that is screwed into a pivot tube 120. Instead of washers, however, the shutter height is set by means of a nut 122 and lock nut 123. The pivot assembly includes a bracket plate 124 that is screwed into the wooden bottom rail.

Figure 34:
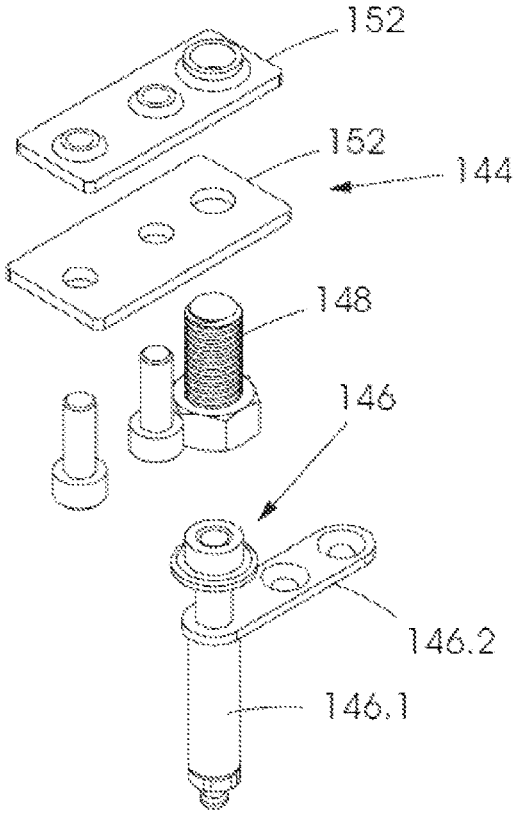
Figure 35:
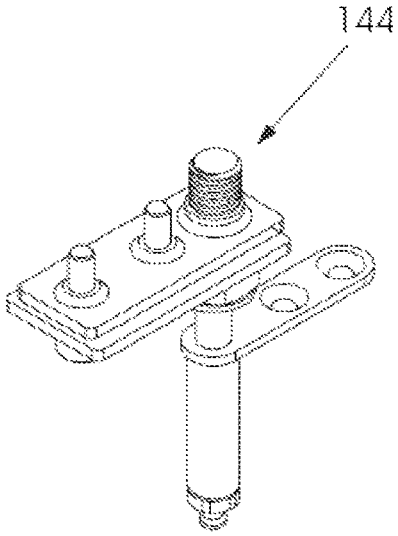

FIGS. 34 and 35 illustrate a fixed top pivot assembly 144 for use with wooden shutters. The pivot assembly 144 is similar to the pivot assembly 126 of FIG. 33, but differs therefrom by the provision of a spring-loaded pivot pin 146 that is configured to engage a pivot socket formed within a pivot bolt 148 is screwed into the clamping plates 150, 152 of the pivot assembly 144—the pivot socket is formed on the underside of the pivot bolt 148 and is not visible in the drawings.

The use of a nut and locknut arrangement 122, 123 in the top pivot assembly 116 of FIG. 32 and a spring-loaded pivot pin 146 in the top pivot assembly 144 of FIG. 34 provide for greater ease of installation, but render the pivot assemblies less secure than the pivot assemblies of FIGS. 31 and 33. This is why these pivot assemblies are used on wooden shutters, which are used mainly indoors and in high-risk areas.

FIGS. 36 to 39 illustrate movable pivot assemblies.

Figure 36:
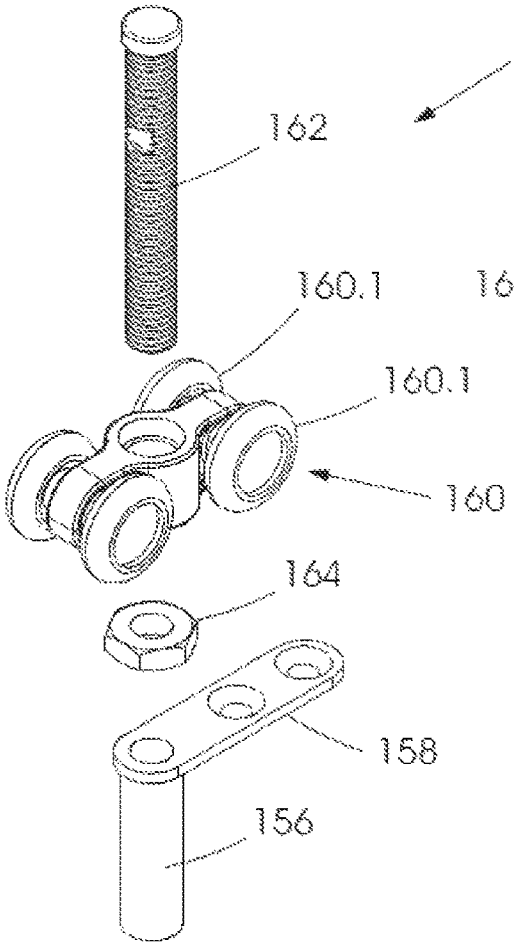
Figure 37:
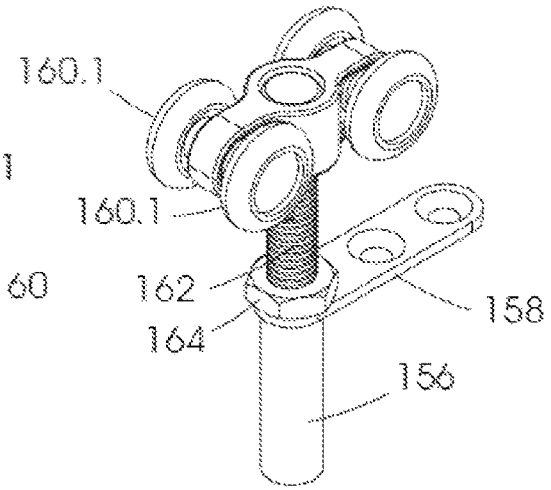

FIGS. 36 and 37 illustrate a shutter roller hanger 154 that utilises a pivot tube 156 and bracket 158 assembly similar to the pivot assemblies described immediately above and which, like these assemblies, is screwed into the top rail 14 to secure the pivot tube 156 in the pivot tube housing 75 formed in the stile plug 74. A wheeled roller carriage 160 is suspended from a headed, threaded hanger bolt 162. The free end of the hanger bolt 162 is threaded into the pivot tube 156 to the required depth and secured in place by means of a lock nut 164. The roller hanger 154 provides a top sliding pivot that permits the hinge axes of the shutters 10 to slide within the plane of the frame.

Figure 38:
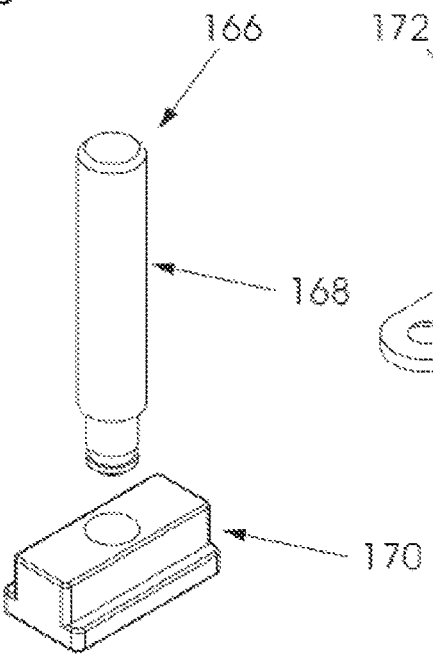

FIG. 38 is a sliding bottom pivot guide 166 that includes a pivot pin 168 inserted into a runner block 170 that runs in a bottom track of the frame to permit the hinge axes of the shutters 10 to slide within the plane of the frame.

Figure 39:
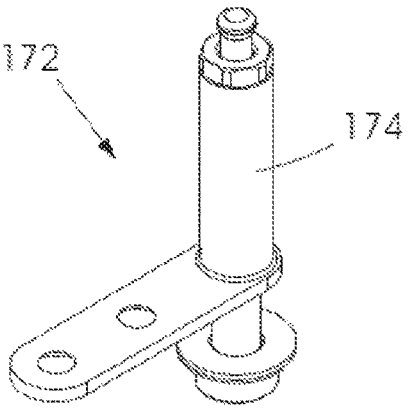

FIG. 39 is a bottom pivot guide 172 similar to the pivot guide 166, that includes a spring-loaded pivot pin 174. The pivot guide 172 is for use with wooden shutters 10.

Referring to FIGS. 31 to 39, it will be evident that the pivot pin/bracket plate assemblies numbered 110/112, 120/124, 136/138, 146.1/146.2, 156/158 and the spring-loaded pivot pin/bracket plate assembly 174 illustrated in FIG. 39 are essentially the same part.

FIGS. 40 to 53 illustrate, in cross-section, the various extruded frame member and track profiles or extrusions used to construct the shutters 10 and various parts of the shutter system of the invention. The various profiles are numbered, in a 200-number series, as close as possible to the numbering of the various components made from these profiles.

Figure 40:
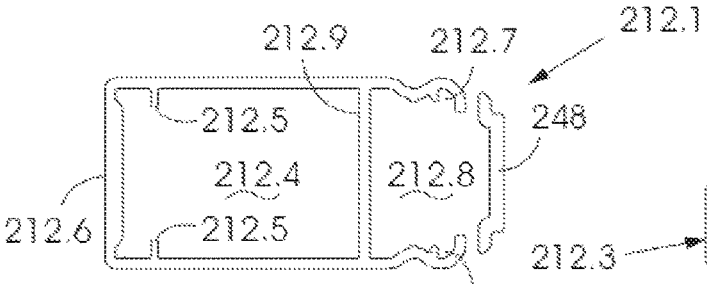
FIGS. 40 to 53 are cross-sections of extruded frame-, cover plate- and track elements for the shutter system of the invention.
Figure 41:
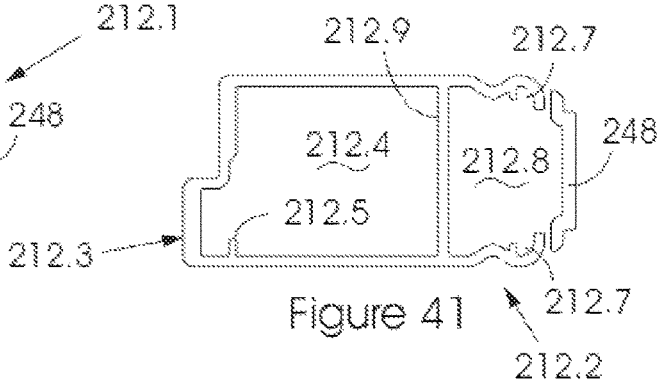

FIGS. 40 and 41 illustrate two variations 212.1, 212.2 of stile profiles 212 that are used to create the stiles 12 used in the manufacture of the shutters 10.

The stile profile 212.1 of FIG. 40 is a flat stile used in the construction of non-overlapping shutters 10, such as shutters 10 intended for mounting against a shutter system frame or an opening frame—in bi-fold systems, the shutters 10 occurring at the ends of the bi-fold shutter system.

The stile profile 212.2 of FIG. 41 is a rebated stile used in the construction of overlapping shutters 10. These are hinged shutters 10 intended for mounting adjacent other shutters in a bi-fold shutter system such that the un-rebated portions 212.3 of the profiles 212.2 overlap to close the gaps between stiles 12.

The stile profiles 212 are separated into housings first and second housings 212.4, 212.8 by means of a separator 212.9.

The housings 212.4, 212.8, in combination, locate and support the stile plug 74 after removal of the separator 212.9 from the area in which the stile plug 74 will be located. In addition, the profile 212 includes longitudinally extending ribs 212.5 that can be ground or routed away just sufficient to support the stile plug 74 in the correct position within the housing 212.4, 212.9.

The first housing 212.4 houses and locates the locking mechanism 50 and lock bolts 72, on one side of a shutter 10, and, in automated shutter systems, the housing 212.4 on the other side of the shutter frame houses and locates the electrical control- and drive module 704 described below.

The stile profiles 212 are formed with cover strip retaining channels 212.7 that are shaped complementally to the edges of the cover strip profile 248, which produces the stile cover strip 48 of FIGS. 12 to 15. The cover strip retaining channels 212.7 receive the edges of the stile cover strip 48.

The second housing 212.8 houses and locates the tilter rack assembly 42 which is secured to the cover strip 48.1. After securement of the stile cover strip 48.1 to the tilter rack assembly 42, the edges of the stile cover so 48.1 are slid into the cover strip retaining channels 212.7 to locate the tilter rack assembly 42 and cover strip 48.1 combination within the stile 12. This locates the tilter rack assembly 42 within the second housing 212.8 (see FIGS. 12 to 14).

Figure 43:
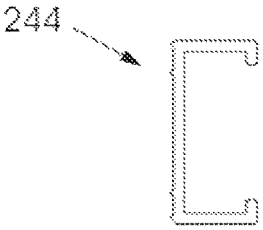

The profile 244 of the tilter track carrier 44 is shown in FIG. 43.

Figure 23:
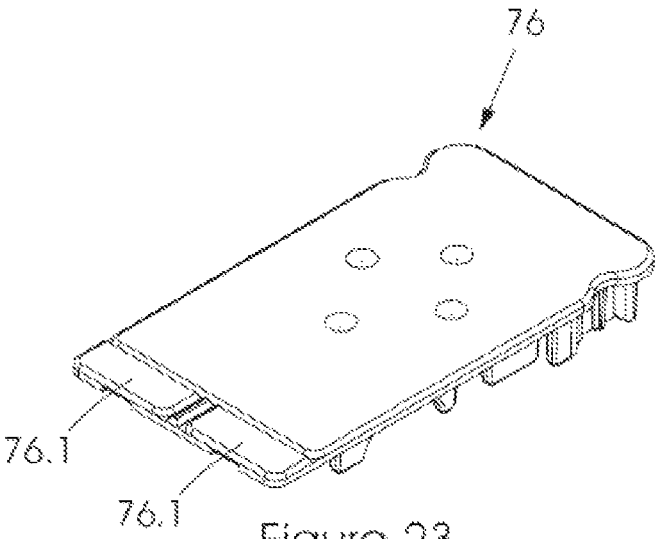
FIGS. 23 and 24 are isometric views, from above and below, respectively, of a stile plug closing plate according to the invention.
Figure 24:
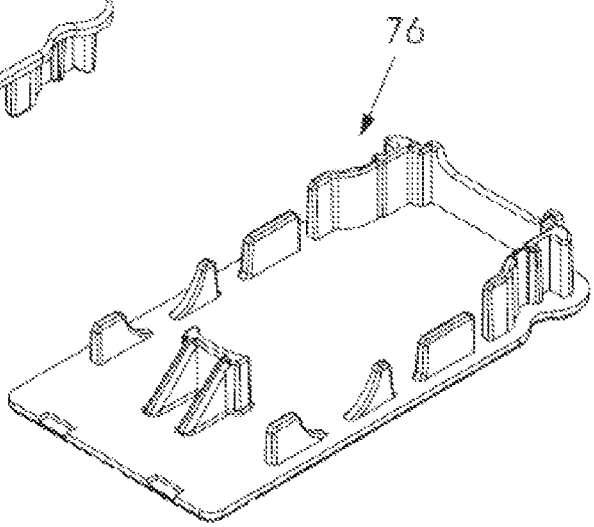
Figure 25:
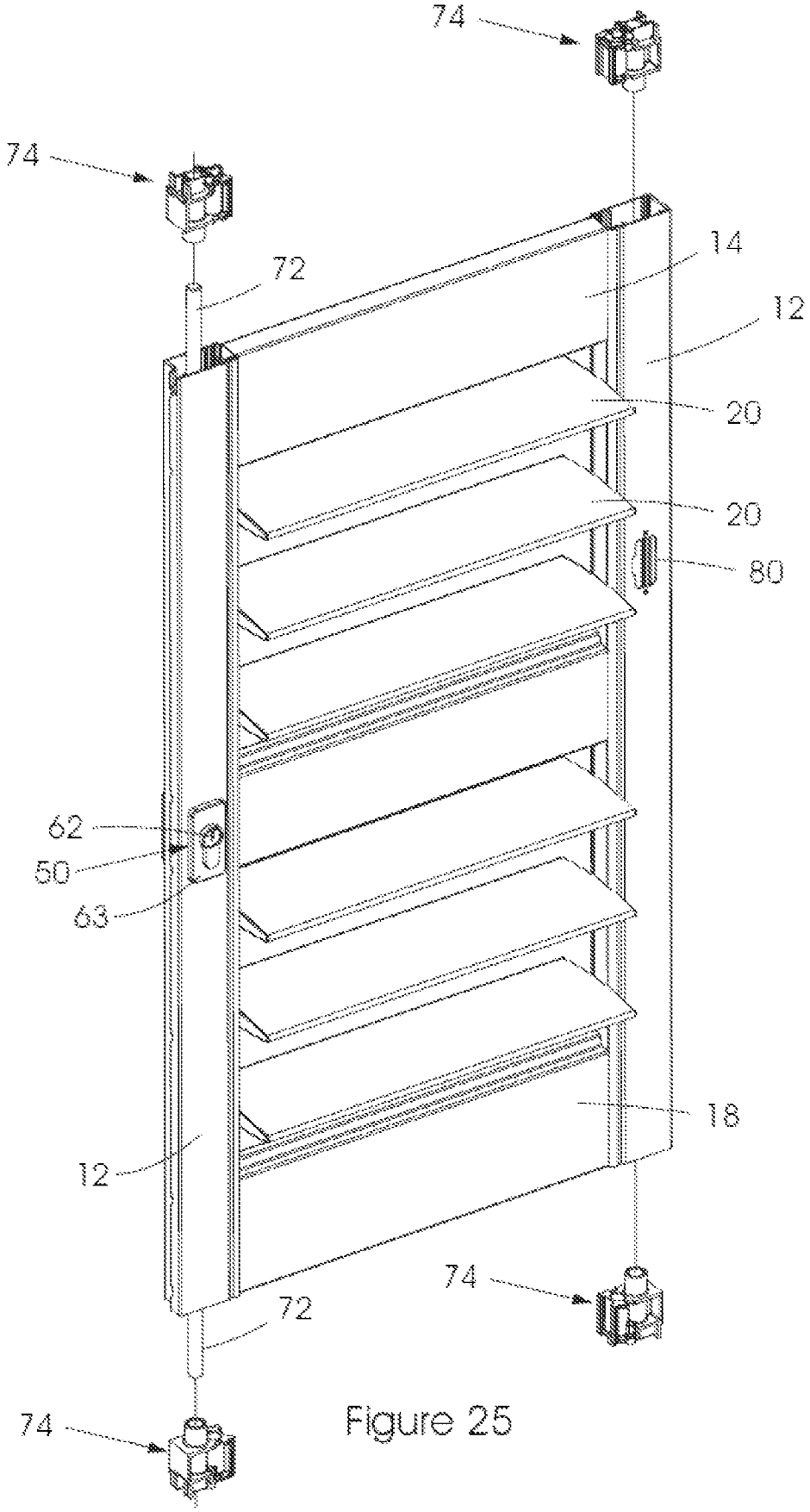
FIG. 25 is an exploded isometric view illustrating the insertion of the stile plugs into the stiles of the shutter of the invention.
Figure 26:
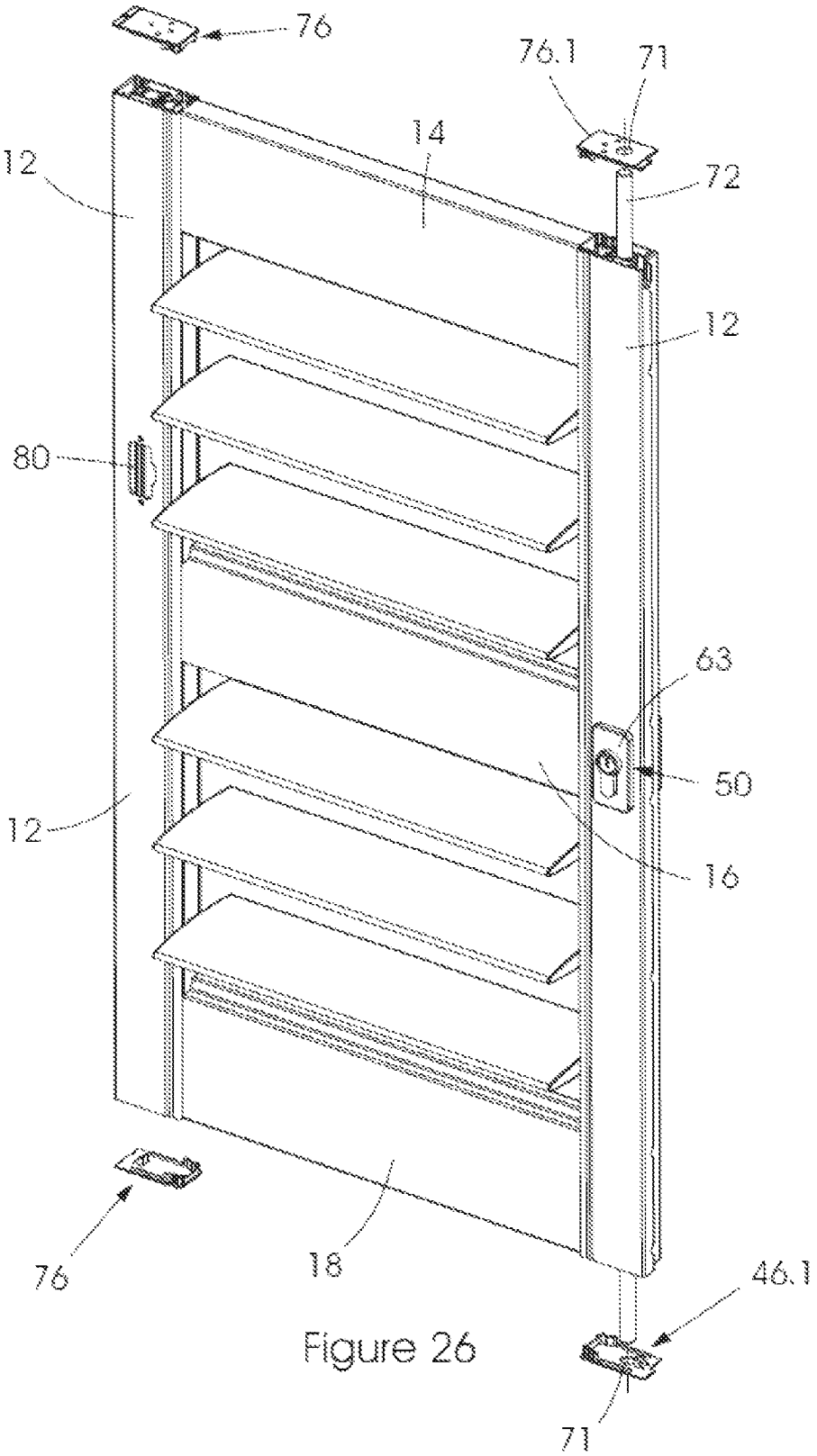
FIG. 26 is an exploded isometric view illustrating the connection of the stile plug closing plates to the stiles of the shutter of the invention.
Figure 27:
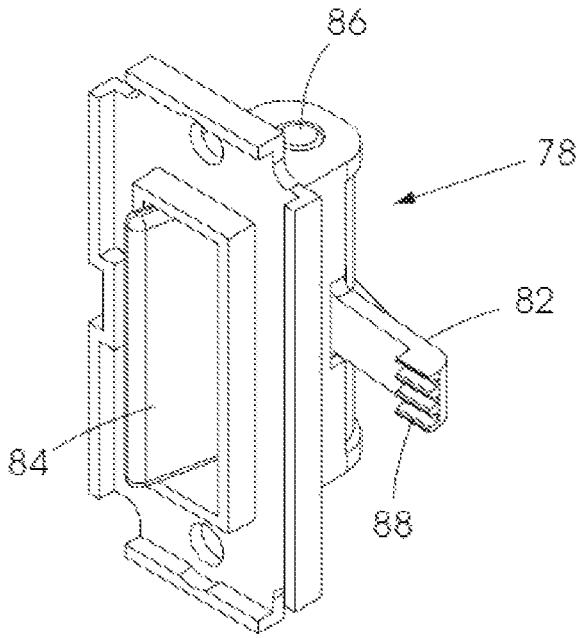
FIG. 27 is an isometric view of a louvre lock according to the invention.
Figure 28:
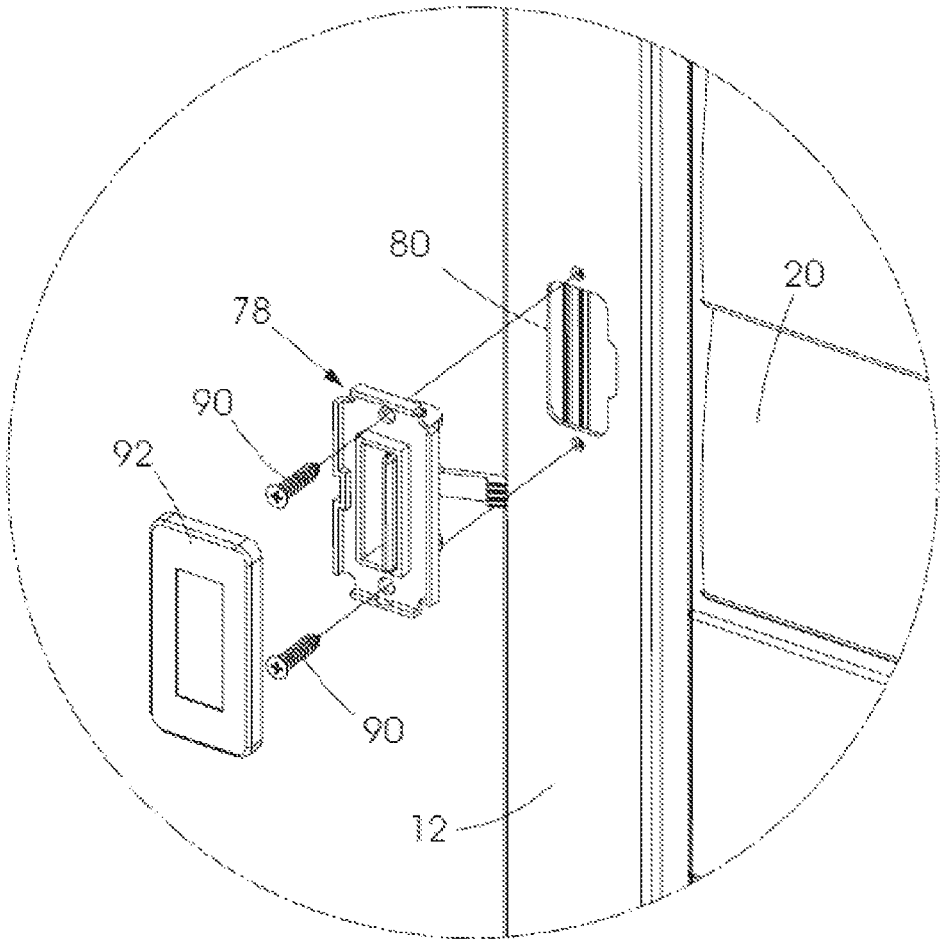
FIG. 28 is an exploded isometric view illustrating the assembly of the louvre lock of FIG. 27 to a shutter according to the invention.

The stile plug closing plates 76 illustrated in FIGS. 23 and 24 are configured to clip into the channels and housings 212.4, 212.8 formed within the stile profile 212, but also include formations to clip into complementally shaped formations on the stile plug 74. The stile plug closing plates 76 are formed with knock-off tabs 76.1 that can be removed to clear the rebated portion 202.6 of the rebated stile profile 212.2 to prevent the stile plug closing plate 76 from interfering with the non-rebated portion 212.3 of an adjacent stile when the rebated stiles 202.2 are closed against one another in use.

The stile profiles 212 are configured and dimensioned to conform to the sizing and aesthetics of wooden shutters. This enables almost interchangeable use of wooden, aluminium and PVC shutters within a single interior without changing the look and feel of the interior. It also enables processing of wooden, aluminium and PVC components on very similar, if not identical, production machinery.

Figure 42:
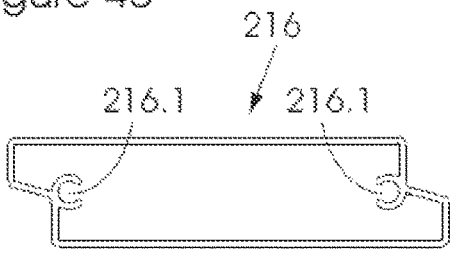

The centre rail profile 216 illustrated in FIG. 42 is used to produce centre rails 16 in the shutters 10. The centre rail profile 216 is extruded with longitudinally extending screw channels 216.1 into which the frame screws 22 are screwed during assembly of the stiles 12 to the centre rail 16.

The centre rail profile 216 is dimensioned to replace a single louvre pitch (typically 80 mm.) To allow for automation of the louvres above and below the centre rail 16 with a single control module (described in more detail below). Alternatively, dual control modules can be added and, by removing a single tilter rack 40, the top and bottom louvre panels can be adjusted independently of each other.

Figure 44:
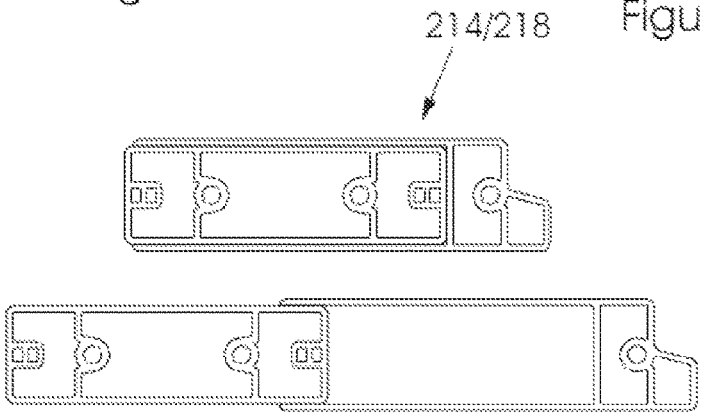

Adjustable rail profiles 214/218 are illustrated in FIG. 44. These profiles are used to produce top (14) and bottom (18) rails in a shutter 10. The adjustable profiles 214/218 allow adjustment of the shutter panel heights to allow for vertical variations in shutter size.

The shutters 10 of the invention are mounted within a shutter system frame made up of dedicated frame components, as described below.

Figure 45:
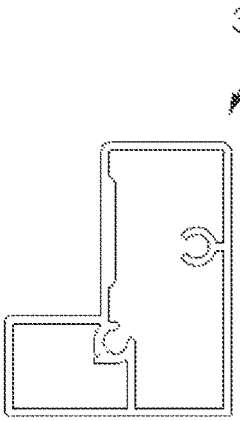
Figure 46:
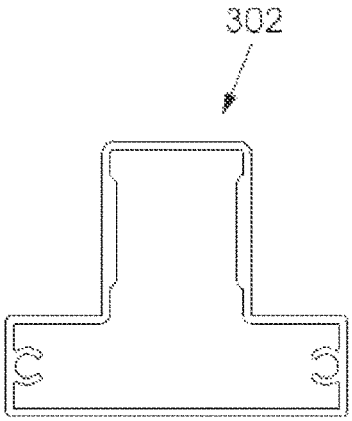
Figure 47:
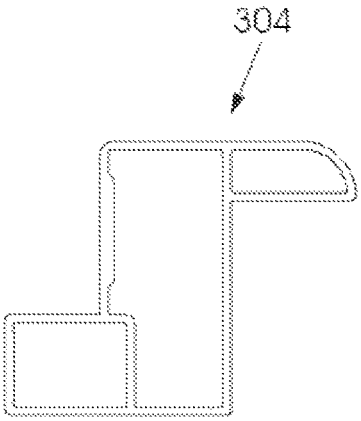

The L-frame, T-post and Z-frame profiles 300, 302, 304 illustrated in FIGS. 45 to 47 are used in shutter systems where the shutter system is installed in a straight or right-angled building opening, such as a window or door frame. However, both the L-frame 300 and the Z-frame 304 could be used in shutter systems installed in non-straight and non-right-angled building openings, such as bay window constructions.

Figure 48:
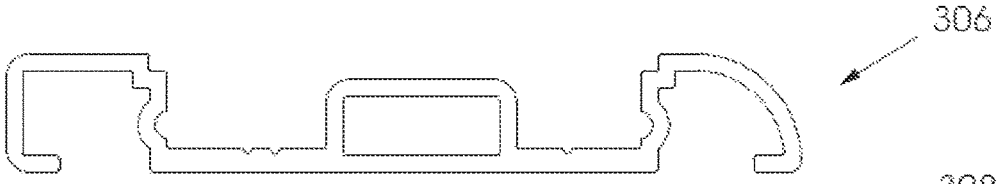
Figure 49:
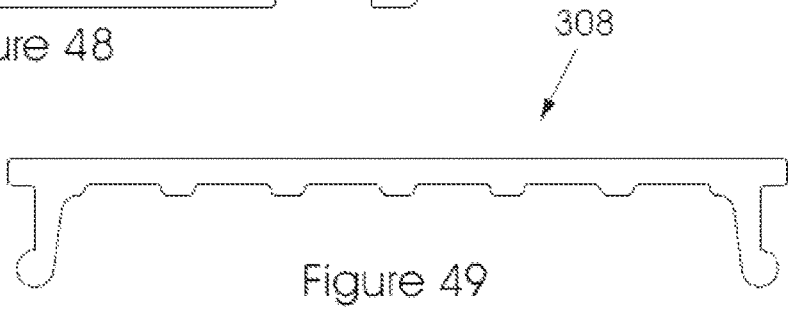

The fascia bullnose profile 306 illustrated in FIG. 48 is used as a finishing frame, primarily in tracked bi-fold shutter systems. A fascia bullnose cover plate profile 308, illustrated in FIG. 49, is used to provide a cover plate that is used to cover the fascia bullnose 306 and to hide fixing screws.

Figure 50:
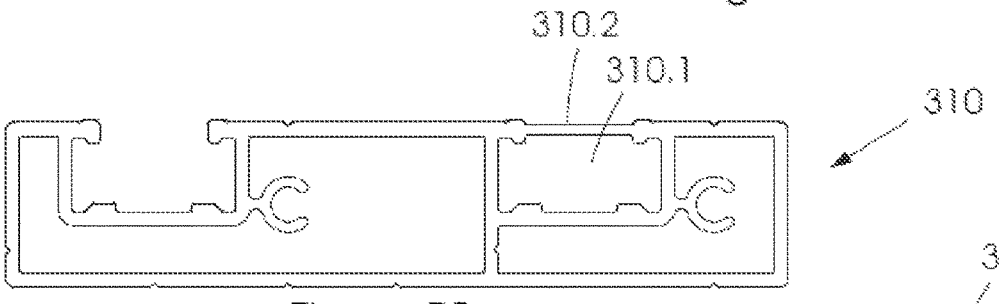

The head/side board two-way track profile 310 illustrated in FIG. 50 is used as a side board for tracked bi-fold shutter systems as well as a header board and a bottom guide board. The two-way track profile 310 includes an initially closed secondary track 310.1 covered by means of an integrally extruded cover plate 310.2 that may be removed by grinding or routing to expose the secondary track 310.1, to enable the construction of a sliding panel system, for instance.

Figure 51:
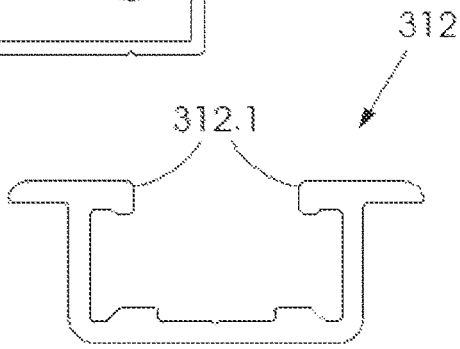

A recessed bottom track profile 312 is illustrated in FIG. 51. The profile 312 is used to produce a bottom track that is mounted in a recess or slot formed in the floor where the shutter system is to be installed.

Figure 52:
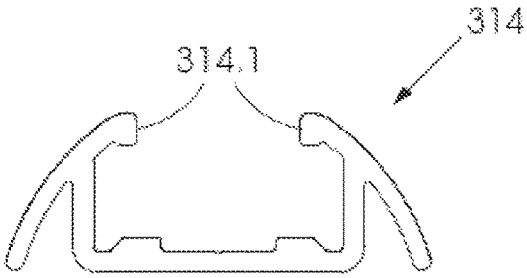

A surface bottom track profile 314 is illustrated in FIG. 52. The profile 214 is used to produce a bottom track configured for surface mounting on the floor where the shutter system is to be installed.

The bottom track profiles 312, 314 include return formations 312.1, 314.1 that, in the resultant bottom tracks, produce an undercut slot that is configured slidably to retain the runner blocks 106,170 of the sliding bottom pivot guides 166. The undercut slot will also accommodate the base plates 106 of fixed bottom pivot assemblies 104, 116 fixed within the track by grub screws screwed into the track.

Figure 53:
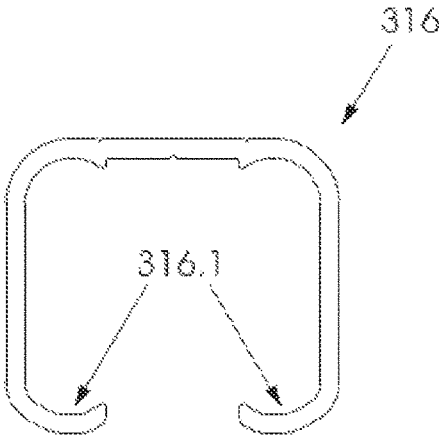

The top track profile 316 illustrated in FIG. 53 is used to produce a top track that accommodates the top pivot assemblies. The top track profile 316 includes inwardly curved return formations 316.1 that, in the resultant top track, produce an undercut slot that is configured slidably to retain the top pivot assemblies 126, 144, 154.

In the case of the fixed top pivot assemblies 126, 144, the clamping plates 128, 130; 150, 152 are clamped, by bolting, around the return formations 316.1.

In the case of the top sliding pivot assemblies constituted by the roller hangers with 154, the wheels 150.1 of the wheeled roller carriage 160 are accommodated within the inwardly curved sides of the return formations 316.1, which serve as longitudinally extending tracks for the wheels 160.1.

Figure 54:
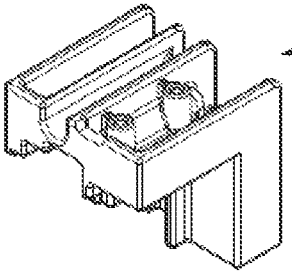
FIGS. 54 and 55 are isometric views of a frame corner connector block for the shutter of the invention.
Figure 55:
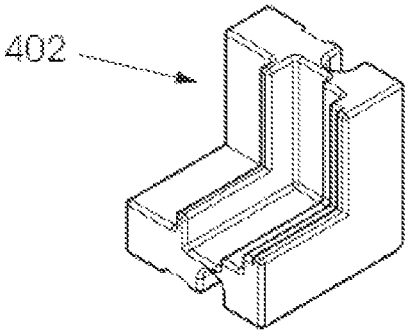
Figure 56:
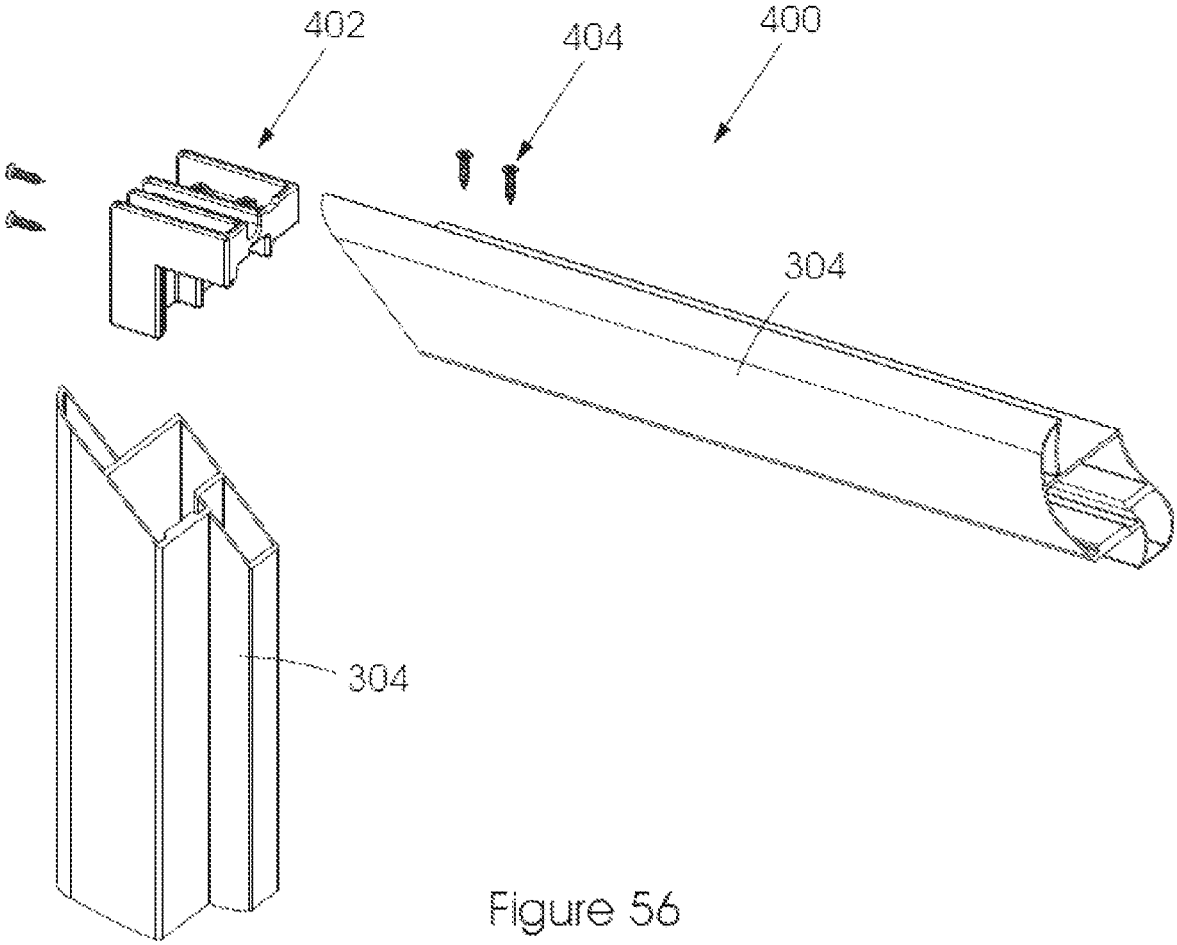
FIG. 56 is an exploded isometric view of the corner connector block of FIGS. 54 and 55 in use in the assembly of a shutter frame.

A shutter system frame 400 configured to frame a straight or right-angled building opening is illustrated in FIG. 56, which shows a pair of mitred Z-frames 304 in the process of connection to one another by means of a right-angled frame corner connector 402, which is illustrated in more detail in FIGS. 54 and 55. The connector 402 is configured for insertion in and engagement with the internal surfaces of the Z-frame profile 304, after which the corner connector 402 and the Z-frame pieces 304 are connected to one another by means of screws 404.

Figure 61:
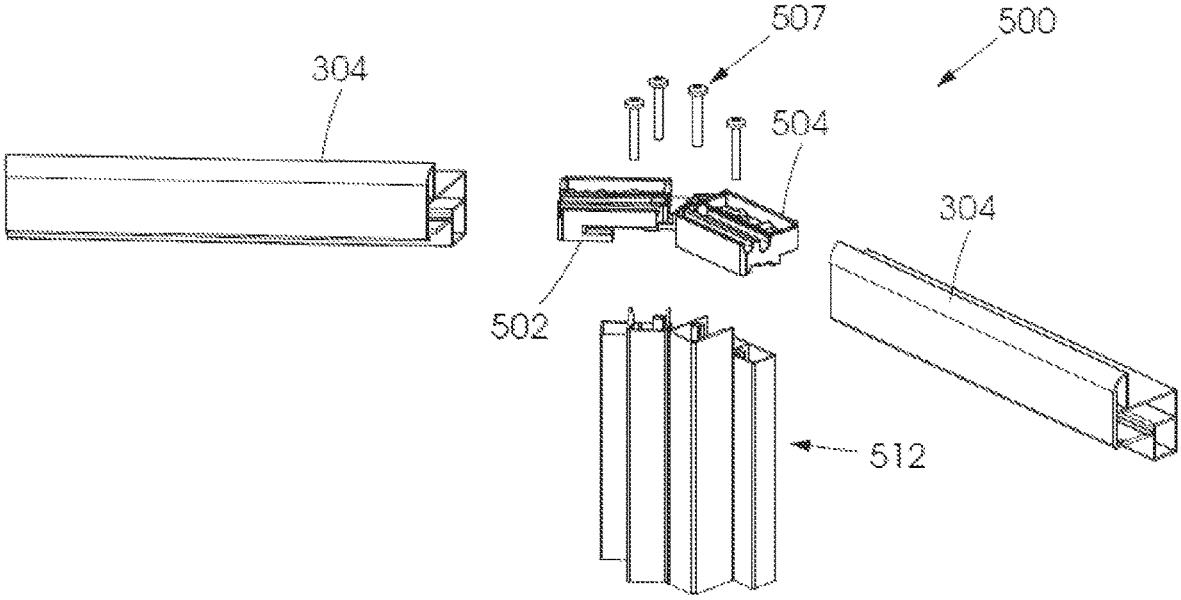
FIG. 61 is an exploded isometric view illustrating the use of the corner blocks of FIGS. 57 to 60 in the assembly of an angled shutter frame.

A shutter system frame 500 configured to frame an angled building opening (such as a bay window) with an angle between surfaces of 135° (plus or minus between 5° and 10°), is illustrated in FIG. 61, which shows a pair of Z-frames 304 cut to the appropriate angles, in the process of connection to one another by means of interconnected corner connectors, including a common connector block 502 and an angled connector block 504.

Figure 57:
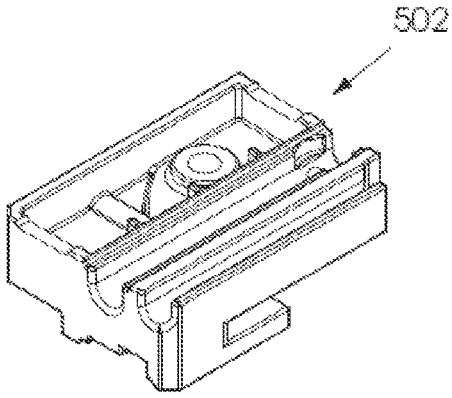
FIGS. 57 and 58 are isometric views of a common frame corner connector block for use with the frame connector blocks of FIGS. 59, 60, 62 and 63.
Figure 58:
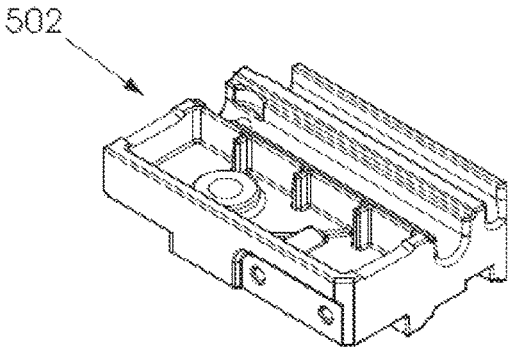

The common connector block 502 is illustrated in more detail in FIGS. 57 and 58.

Figure 59:
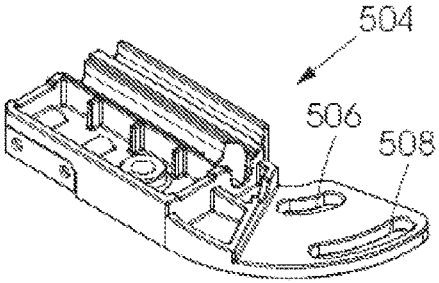
FIGS. 59 and 60 are isometric views of a frame corner joiner block used in the assembly of an angled shutter frame.
Figure 60:
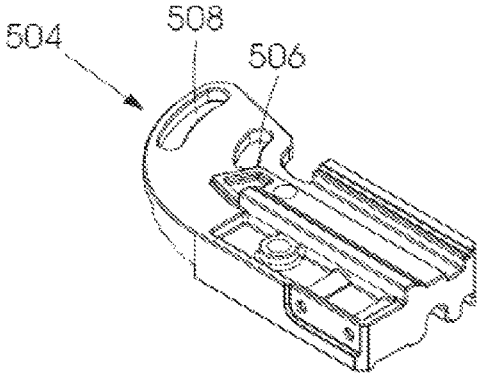

The angled connector block 504, which is illustrated in more detail in FIGS. 59 and 60 is formed with curved slots 506, 508 that permit bolted or screwed securement (by means of screws 510) of the angled connector block 504 to the common connector block 502 at an angle of 135° (plus or minus between 5° and) 10°, and hence permit the construction of shutter system frames 500 at these angles.

The connector blocks 502, 504 are configured to retain and allow the screwed securement (by means of the screws 510) of a number of vertical frame elements 512, including the L-frame and Z-frame profiles 300, 304 illustrated in FIGS. 45 and 47.

Figure 64:
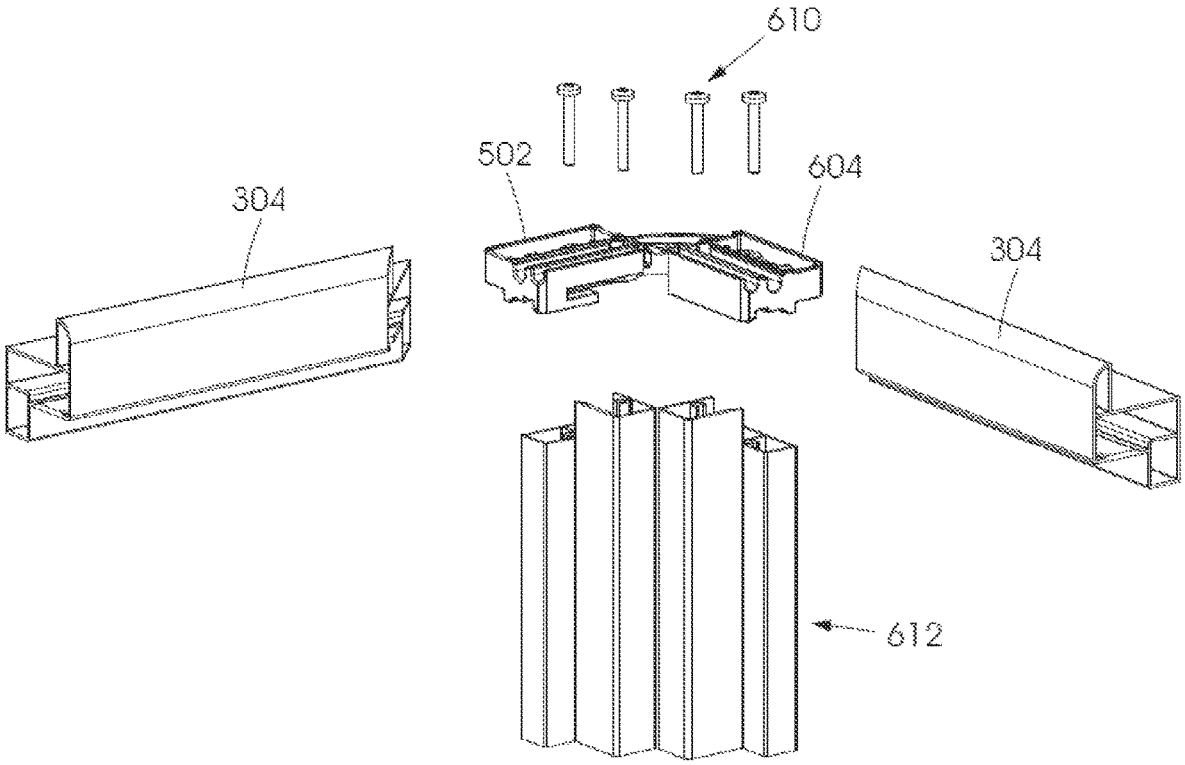
FIG. 64 is an exploded isometric view illustrating the use of the corner blocks of FIGS. 57, 58, 62 and 63 in the assembly of a right-angled shutter frame.

A shutter system frame 600 configured to frame an angled building opening (such as a bay window) with an angle between surfaces of 90° (plus or minus between 5° and 10°), is illustrated in FIG. 64, which shows a pair of Z-frames 304 cut to the appropriate angles, in the process of connection to one another by means of interconnected corner connectors, including the common connector block 502 of FIGS. 57 and 58 and an angled connector block 604.

Figure 62:
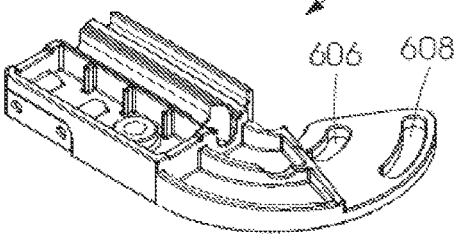
FIGS. 62 and 63 are isometric views of a frame corner joiner block similar to that of FIGS. 59 and 60 used in the assembly of a right-angled shutter frame.
Figure 63:
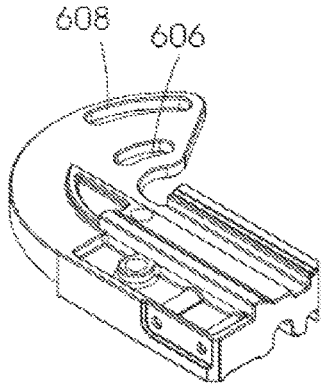

The angled connector block 604, which is illustrated in more detail in FIGS. 62 and 63 is formed with curved slots 606, 608 that permit bolted or screwed securement (by means of screws 610) of the angled connector block 604 to the common connector block 502 at 90° (plus or minus between 5° and 10°) and hence permit the construction of shutter system frames 600 at these angles.

The connector blocks 502, 604 are configured to retain and allow the screwed securement (by means of the screws 610) of a number of vertical frame elements 512, including the L-frame and Z-frame profiles 300, 304 illustrated in FIGS. 45 and 47.

Figure 68:
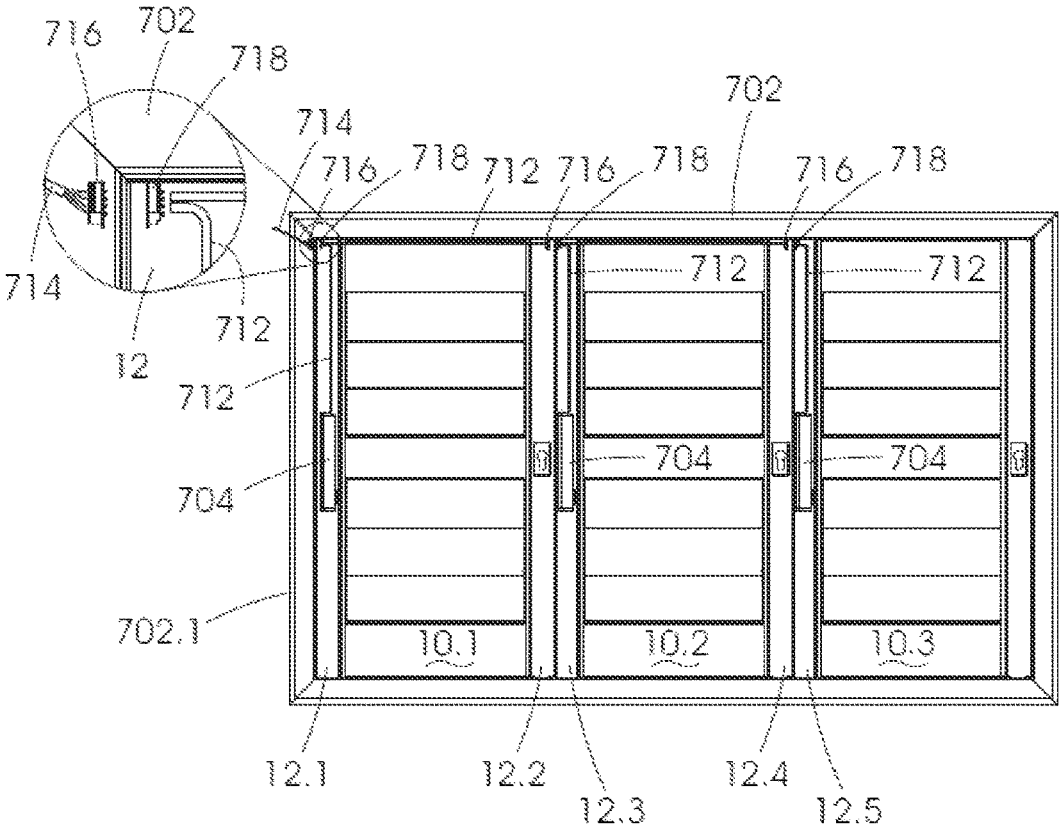
FIG. 68 is a view on an assembled automated shutter system according to the invention, mounted within a shutter system mounting frame.

FIG. 68 illustrates a framed bi-fold shutter system 700 in which a plurality of shutters 10 are mounted, concertina-fashion, within a frame 702. In the system 700, the louvre drive system is automated by means of an electrical control- and drive module 704 installed in each shutter 10 and an electrical wiring harness connecting the control modules to one another.

Figure 67:
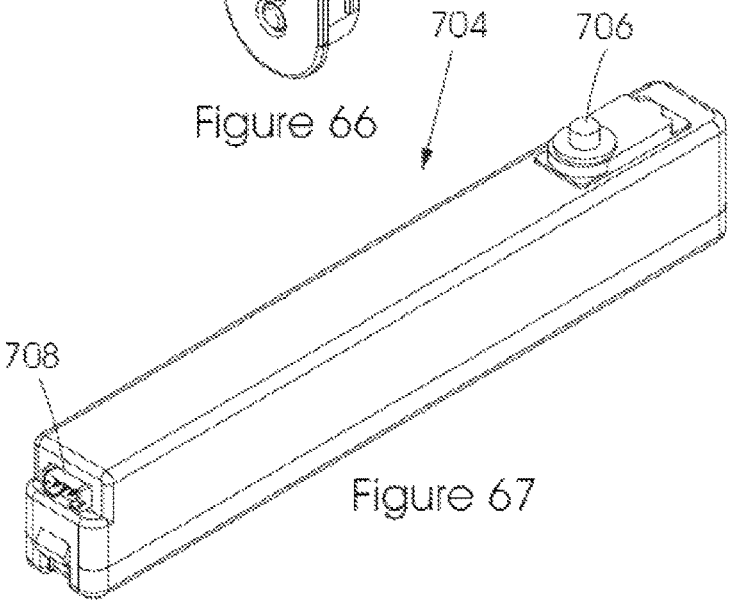
FIG. 67 is an isometric view of an automation control module according to the invention.

The control module 704 is illustrated in FIG. 67 and includes an electric motor (internal—not shown) that is remotely operated by means of a radio frequency remote controller or the like. The electric motor drives a gear axle 706 to which a pinion gear (not shown) is mounted, the motor being connected into the wiring harness, which is plugged into an electrical plug 708. Prior to mounting of the control module pinion gear, the control module 704 is mounted within the housing 212.4 in the stile profile 212, with the gear axle 706 projecting through a purpose-made hole in the separator 212.9 and the drive hole 44.2 formed in the tilter rack carrier 44. The control module pinion gear is then meshed with the tilter racks 40 and secured to the axle 706.

Actuation of the motor in the control module 704 drives the pinion gear to drive the tilter racks 40 in one or the other direction. The tilter racks 40, being in engagement with the louvre pinion gears 28 of the louvres 10, drive the pinion gears 28 of the louvres 10 to rotate the louvres 10 when driven by the motor-driven tilter racks 40.

To enable electricity supply across all the shutters 10 in the system 700, the control modules 704 in each of the shutters 10 are wired into a wiring harness comprising electrical conductors 712 fed from a mains electrical supply 714 installed in the frame 702. The wiring harness includes electrical contact assemblies to connect the electrical conductors 712 in each shutter 10 to one another when the shutters 10 are closed.

Figure 65:
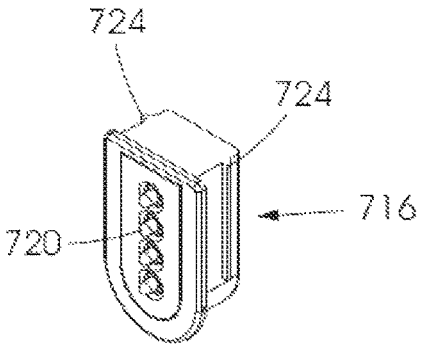
FIGS. 65 and 66 are isometric views of contact assemblies for an automated shutter system according to the invention.
Figure 66:
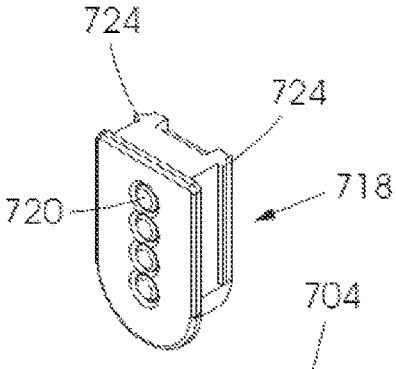

To ensure proper electrical contact, the contact assemblies are mounted in pairs, each including a spring contact assembly 716 (illustrated in FIG. 65) and a fixed contact assembly 718 (illustrated in FIG. 66). In the spring contact assembly 716, the electrical contacts 720 are spring-loaded and in the fixed contact assembly 718, the electrical contacts 722 are fixed. The contact assemblies 716, 718 are shaped complementally, with complemental external shapes and with the electrical contacts 720, 722 in each of the assemblies 716, 718 being positioned such that corresponding contacts will make contact with one another when, in use, the contact assemblies 716, 718 are brought together when the shutters 10 are closed.

In the shutters 10, the contact assemblies 716, 718 are mounted in the un-rebated portions 212.3 of the profiles 212.2 or, in the profiles 212.1, on the flat faces 212.6 of the profile 212.1, in openings made for this purpose. The contact assemblies 716, 718 include retaining formations 724 that are shaped complementally to engage the sheet metal of the profiles 212.

The stile plugs 74 are formed with recesses 79 to accommodate the contact assemblies 716, 718 and the wiring extending from the contact assemblies 716, 718.

In FIG. 68, a spring contact assembly 716 is mounted in an upright frame member 702.1 forming part of the frame 702 and a matching fixed contact assembly 718 is mounted in the opposing stile 12.1 of the first shutter 10.1 that closes against the frame member 702.1. This arrangement is repeated across the remaining shutters 10. A spring contact assembly 716 is mounted in the other stile 12.2 of the first shutter 10.1 and a matching fixed contact assembly 718 is mounted in the opposing stile 12.3 of the second shutter 10.2 that closes against the stile 12.2. Likewise, a spring contact assembly 716 is mounted in the other stile 12.4 of the second shutter 10.2 and a matching fixed contact assembly 718 is mounted in the opposing stile 12.5 of the third shutter 10.3 that closes against the stile 12.4.

The control module 704 is preferably wired or programmed (in a control module including programmable logic) automatically to rotate all the louvres 20 in the system 700 to the closed position of the louvres 20 if contact across any one of the pairs of contact assemblies 716, 718 is broken. Such broken contact invariably signals a shutter opening action and closing of the louvres 20 will prevent accidental damage to the shutters 10 and louvres 20, which might occur if the louvres 20 are left rotated to their open position when the shutters 10 are closed.

The control module 704 and wiring harness may be incorporated into a premises intrusion detection and alarm system (not shown). In particular, the control module 704 may incorporate an impact or vibration sensor (not shown) that is preferably connected to the premises intrusion detection and alarm system, the sensor being configured to activate an alarm in the event that a shutter 10 including the control module 704 is subjected to impact or vibration exceeding a predetermined threshold, which threshold is selected to indicate unauthorised entry.

What is claimed is:

1. A louvre shutter comprising:

a louvre shutter frame comprising a pair of opposed vertical side stiles;

a plurality of rotatably operable louvres, each rotatably mounted in the louvre shutter frame on a louvre axle;

a rack and pinion louvre drive system mounted within an enclosed housing formed within the louvre shutter frame; and a double shoot bolt lock assembly;

wherein:

the rack and pinion louvre drive system comprises an externally operable louvre drive rack reciprocably mounted in the enclosed housing and a plurality of tilter pinion gears, wherein each of the plurality of tilter pinion gears is mounted to the louvre axle of a respective one of the plurality of rotatably operable louvres and is engaged with the louvre drive rack such that reciprocation of the louvre drive rack rotates the tilter pinion gears, causing the plurality of rotatably operable louvres to rotate between an open position and a closed position;

each of the plurality of rotatably operable louvres each include a louver end plug with an outer face and external boss extending outwardly from the outer face, the external boss comprising a right circular cylindrical inner section and an outer section, wherein the right circular cylindrical inner section constitutes the louvre axle on which one of the plurality of rotatably operable louvres is mounted for rotation with louvre mounting holes pre-formed in the pair of opposed vertical side stiles, and the outer section defines an externally keyed driver formation;

each of the plurality of tilter pinion gears:

is mounted on an external boss of a respective one of the plurality of rotatably operable louvres; and comprises externally facing tilter pinion gear teeth and an internal socket formation shaped complementally to and engaged with the externally keyed driver formation of the respective one of the plurality of rotatably operable louvres;

the double shoot bolt lock assembly comprises:

a lock housing dimensioned to fit within one of the pair of opposed vertical side stiles;

a bolt rack mounted for reciprocating movement relative to the lock housing and to extend partially into and partially out of the lock housing, the bolt rack comprising rack gear recesses;

at least one frame lock bolt mounted to a portion of the bolt rack extending from the lock housing and configured for reciprocation into and out of engagement with a locking aperture formed in a surround in which the louvre shutter is mounted in use;

a double sided barrel lock comprising a lock pinion gear with externally facing lock pinion gear teeth mounted on a lock barrel rotatably mounted within the lock housing such that, when rotated, the lock barrel rotates the lock pinion gear, the lock pinion gear teeth configured to mesh with the rack gear recesses; and a rack and pinion locking assembly operably connected to the at least one frame lock bolt, the rack and pinion locking assembly configured to rotate the lock pinion gear to drive the bolt rack reciprocally relative to the lock housing, which causes the at least one frame lock bolt to move reciprocally into and out of the engagement with the locking aperture in the surround.

2. The louvre shutter of claim 1, wherein:

the bolt rack comprises a locking zone adjacent the portion of the bolt rack extending from the lock housing, and an unlocking zone remote from the portion of the bolt rack extending from the lock housing, and first and second sides;

rack gear recesses located within the locking zone are closed rack gear recesses that comprise closed-sided slots that do not open to either of the first and second sides, and which are configured to permit entry of the lock pinion gear teeth only by penetration arising from rotation of the lock pinion gear teeth; and rack gear recesses within the unlocking zone are open-sided rack gear recesses that comprise open-sided slots that open to at least one of the first and second sides of the bolt rack and are configured to permit entry of the lock pinion gear teeth by rotation of the lock pinion gear teeth and by sliding engagement of the lock pinion gear teeth from the first side or the second side of the bolt rack.

* * * * *